US009490535B2

(12) United States Patent
Boutayeb et al.

(10) Patent No.: US 9,490,535 B2
(45) Date of Patent: Nov. 8, 2016

(54) APPARATUS AND ASSEMBLING METHOD OF A DUAL POLARIZED AGILE CYLINDRICAL ANTENNA ARRAY WITH RECONFIGURABLE RADIAL WAVEGUIDES

(71) Applicant: Huawei Technologies Co., Ltd., Shenzhen (CN)

(72) Inventors: Halim Boutayeb, Montreal (CA); Paul Robert Watson, Kanata (CA); Toby Kemp, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 264 days.

(21) Appl. No.: 14/319,884

(22) Filed: Jun. 30, 2014

(65) Prior Publication Data

US 2015/0380815 A1 Dec. 31, 2015

(51) Int. Cl.
*H01Q 3/26* (2006.01)
*H01Q 3/24* (2006.01)
(Continued)

(52) U.S. Cl.
CPC ..... *H01Q 3/24* (2013.01); *H01Q 3/446* (2013.01); *H01Q 15/14* (2013.01); *H01Q 21/0037* (2013.01); *H01Q 21/20* (2013.01)

(58) Field of Classification Search
CPC ..... H03F 1/0288; H03F 3/72; H03F 3/602; H03F 3/211; H03F 3/60; H01Q 3/2629; H01Q 13/00; H01Q 3/242; H01Q 3/247; H01Q 3/26; H01Q 3/24; H01Q 21/064; H01Q 21/005; H01Q 21/0043; H01P 5/182; H01P 1/22; H01P 1/182; H01P 1/39; H01P 3/00; H01P 1/00; H01P 5/00; H01P 5/12; H01P 3/127; H01P 3/12; H01P 5/18
USPC ..... 343/833, 834, 754, 780, 876, 771, 777, 343/774; 330/295, 297; 333/125, 126, 127, 333/128, 129, 130, 131, 132, 133, 134, 135, 333/136, 137
See application file for complete search history.

(56) References Cited

U.S. PATENT DOCUMENTS 2,532,551 A 12/1950 Jarvis
4,072,951 A * 2/1978 Kaloi ..... H01Q 9/0407 343/700 MS (Continued)

FOREIGN PATENT DOCUMENTS

CN 1412890 A 4/2003
CN 102576937 A 7/2012

(Continued)

OTHER PUBLICATIONS

Antenna Array Excited by the Radial Waveguide, Sedek et al.*

(Continued)

*Primary Examiner* — Dameon E Levi
*Assistant Examiner* — Awat Salih
(74) *Attorney, Agent, or Firm* — Slater Matsil, LLP

(57) ABSTRACT

Embodiments are provided for an agile antenna that beam-steers radio frequency (RF) signals by selectively activating/de-activating tunable elements on radial-waveguides using direct current (DC) switches. The agile antenna device comprises a first radial waveguide structure encased in a first frame, a first line feed connected to the first waveguide structure, a second encased radial waveguide structure similar and coupled to the first waveguide structure. The two waveguide structures include the tunable elements controlled by the DC switches. A second line feed is connected to the second waveguide structure. The two line feeds provide the RF signal to the antenna. The antenna device also includes a plurality of radiating elements positioned between the first radial waveguide structure and the second radial waveguide structure, and distributed radially around a circumference of the first radial waveguide structure and a circumference of the second radial waveguide structure.

23 Claims, 30 Drawing Sheets

(51) Int. Cl.

| | |
|---|---|
| ***H01Q 3/44*** | (2006.01) |
| ***H01Q 15/14*** | (2006.01) |
| ***H01Q 21/00*** | (2006.01) |
| ***H01Q 21/20*** | (2006.01) |

(56) References Cited

U.S. PATENT DOCUMENTS

| | | | | |
|---|---|---|---|---|
| 4,605,932 | A * | 8/1986 | Butscher | H01Q 1/286 343/700 MS |
| 4,673,899 | A | 6/1987 | Jespersen et al. | |
| 4,899,162 | A | 2/1990 | Bayetto et al. | |
| 5,767,807 | A | 6/1998 | Pritchett | |
| 7,636,070 | B2 | 12/2009 | De Lustrac et al. | |
| 8,339,327 | B2 * | 12/2012 | Schadler | H01Q 9/0428 343/700 MS |
| 2002/0113743 | A1 | 8/2002 | Judd et al. | |
| 2003/0076271 | A1 | 4/2003 | Borlez et al. | |
| 2005/0201672 | A1 | 9/2005 | Mansour et al. | |
| 2006/0176124 | A1 | 8/2006 | Mansour et al. | |
| 2008/0316139 | A1 * | 12/2008 | Blaser | H01Q 21/064 343/872 |
| 2011/0080325 | A1 | 4/2011 | Livneh et al. | |
| 2013/0342424 | A1 | 12/2013 | Park et al. | |
| 2014/0218237 | A1 | 8/2014 | Boutayeb | |

FOREIGN PATENT DOCUMENTS

| | | | |
|---|---|---|---|
| CN | 102832432 | * | 12/2012 |
| CN | 102832432 | A | 12/2012 |
| CN | 103811849 | A | 5/2014 |
| JP | 2000-196350 | A | 7/2000 |

OTHER PUBLICATIONS

Broadband Radial Waveguide Spatial Combiner, Song et al.*
Broadband radial waveguide power amplifier using a spatial power combining technique, K. Song et al.*
The High-Power Radial Line Helical Circular Array Antenna: Theory and Development, Li et al.*
International Search Report received in Application No. PCT/CN2015/082586, mailed Sep. 2, 2015, 11 pages.
International Search Report received in Application No. PCT/CN2015/082894, mailed Sep. 21, 2015, 10 pages.

* cited by examiner

LOWER POWER DIVIDER (PIN 1 TO 20)

| DIRECTION | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | GND | GND | 0 | 0 | 0 | 0 | 0 | 0 | 0 | 0 | 0 | 0 | 0 | 0 | 0 | 1 | 0 | 1 | 1 | 1 |
| 2 | GND | GND | 0 | 0 | 0 | 0 | 0 | 0 | 0 | 0 | 0 | 0 | 0 | 1 | 0 | 1 | 0 | 1 | 0 | 0 |
| 3 | GND | GND | 0 | 0 | 0 | 0 | 0 | 0 | 0 | 1 | 0 | 1 | 0 | 1 | 0 | 1 | 0 | 0 | 0 | 0 |
| 4 | GND | GND | 0 | 0 | 0 | 0 | 0 | 1 | 0 | 1 | 0 | 1 | 0 | 0 | 0 | 0 | 0 | 0 | 0 | 0 |
| 5 | GND | GND | 0 | 1 | 0 | 1 | 0 | 1 | 0 | 1 | 0 | 0 | 0 | 0 | 0 | 0 | 0 | 0 | 0 | 0 |
| 6 | GND | GND | 1 | 1 | 0 | 1 | 0 | 0 | 0 | 0 | 0 | 0 | 0 | 0 | 0 | 0 | 0 | 0 | 0 | 0 |
| 7 | GND | GND | 1 | 1 | 1 | 0 | 1 | 0 | 0 | 0 | 0 | 0 | 0 | 0 | 0 | 0 | 0 | 0 | 0 | 0 |
| 8 | GND | GND | 0 | 0 | 1 | 0 | 1 | 0 | 1 | 0 | 0 | 0 | 0 | 0 | 0 | 0 | 0 | 0 | 0 | 0 |
| 9 | GND | GND | 0 | 0 | 0 | 0 | 1 | 0 | 1 | 0 | 1 | 0 | 1 | 0 | 0 | 0 | 0 | 0 | 0 | 0 |
| 10 | GND | GND | 0 | 0 | 0 | 0 | 0 | 0 | 0 | 0 | 1 | 0 | 1 | 0 | 1 | 0 | 0 | 0 | 0 | 0 |
| 11 | GND | GND | 0 | 0 | 0 | 0 | 0 | 0 | 0 | 0 | 0 | 0 | 1 | 0 | 1 | 0 | 1 | 0 | 1 | 0 |
| 12 | GND | GND | 0 | 0 | 0 | 0 | 0 | 0 | 0 | 0 | 0 | 0 | 0 | 0 | 0 | 0 | 1 | 0 | 1 | 1 |

FIG. 30A

UPPER POWER DIVIDER (PIN 21 TO 40)

| DIRECTION | 21 | 22 | 23 | 24 | 25 | 26 | 27 | 28 | 29 | 30 | 31 | 32 | 33 | 34 | 35 | 36 | 37 | 38 | 39 | 40 |
|---|---|---|---|---|---|---|---|---|---|---|---|---|---|---|---|---|---|---|---|---|
| 1 | GND | GND | 0 | 0 | 0 | 0 | 0 | 0 | 0 | 0 | 0 | 0 | 0 | 0 | 0 | 1 | 0 | 1 | 1 | 1 |
| 2 | GND | GND | 0 | 0 | 0 | 0 | 0 | 0 | 0 | 0 | 0 | 0 | 0 | 0 | 0 | 0 | 1 | 0 | 1 | 1 |
| 3 | GND | GND | 0 | 0 | 0 | 0 | 0 | 0 | 0 | 0 | 0 | 0 | 1 | 0 | 1 | 0 | 1 | 0 | 1 | 0 |
| 4 | GND | GND | 0 | 0 | 0 | 0 | 0 | 0 | 0 | 0 | 1 | 0 | 1 | 0 | 1 | 0 | 0 | 0 | 0 | 0 |
| 5 | GND | GND | 0 | 0 | 0 | 0 | 1 | 0 | 1 | 0 | 1 | 0 | 1 | 0 | 0 | 0 | 0 | 0 | 0 | 0 |
| 6 | GND | GND | 0 | 0 | 1 | 0 | 1 | 0 | 1 | 0 | 0 | 0 | 0 | 0 | 0 | 0 | 0 | 0 | 0 | 0 |
| 7 | GND | GND | 1 | 1 | 1 | 0 | 1 | 0 | 0 | 0 | 0 | 0 | 0 | 0 | 0 | 0 | 0 | 0 | 0 | 0 |
| 8 | GND | GND | 1 | 1 | 0 | 1 | 0 | 0 | 0 | 0 | 0 | 0 | 0 | 0 | 0 | 0 | 0 | 0 | 0 | 0 |
| 9 | GND | GND | 0 | 1 | 0 | 1 | 0 | 1 | 0 | 1 | 0 | 0 | 0 | 0 | 0 | 0 | 0 | 0 | 0 | 0 |
| 10 | GND | GND | 0 | 0 | 0 | 0 | 0 | 1 | 0 | 1 | 0 | 1 | 0 | 0 | 0 | 0 | 0 | 0 | 0 | 0 |
| 11 | GND | GND | 0 | 0 | 0 | 0 | 0 | 0 | 0 | 1 | 0 | 1 | 0 | 1 | 0 | 1 | 0 | 0 | 0 | 0 |
| 12 | GND | GND | 0 | 0 | 0 | 0 | 0 | 0 | 0 | 0 | 0 | 0 | 0 | 1 | 0 | 1 | 0 | 1 | 0 | 0 |

FIG. 30B

APPARATUS AND ASSEMBLING METHOD OF A DUAL POLARIZED AGILE CYLINDRICAL ANTENNA ARRAY WITH RECONFIGURABLE RADIAL WAVEGUIDES

TECHNICAL FIELD

The present invention relates to antenna design, and, in particular embodiments, to an apparatus and assembling method for a dual polarized agile cylindrical antenna array with reconfigurable radial waveguides.

BACKGROUND

Modern wireless transmitters of radio frequency (RF) signals or antennas perform beamsteering to manipulate the direction of a main lobe of a radiation pattern and achieve enhanced spatial selectivity. Conventional beamsteering techniques rely on manipulating the phase of RF signals through a series of phase shifters and RF switches. The inclusion of phase shifters, RF switches, and other complex components increase the manufacturing cost and design complexity of agile antennas. Accordingly, less complex agile antenna designs are desired.

SUMMARY OF THE INVENTION

In accordance with an embodiment, an antenna device comprises a first radial waveguide structure, a first line feed connected substantially at a center of a surface of the radial waveguide structure, and a second radial waveguide structure similar and coupled to the first waveguide structure. The second radial waveguide structure is substantially parallel to and faces the first radial waveguide structure. The antenna device further comprises a second line feed connected substantially at a center of a surface of the second radial waveguide structure. The first line feed of the first radial waveguide structure faces the second line feed of the second radial waveguide structure. The antenna device also includes a plurality of radiating elements positioned between the first radial waveguide structure and the second radial waveguide structure, and distributed radially around a circumference of the first radial waveguide structure and a circumference of the second radial waveguide structure.

In accordance with another embodiment, an antenna device comprises a first radial waveguide structure, a first radial frame enclosing the first radial waveguide structure, a second radial waveguide structure similar to the first waveguide structure, and a second radial frame enclosing the second radial waveguide structure. The second radial frame is similar and coupled substantially in parallel to the first radial frame. The antenna device further comprises a plurality of radiating elements positioned between the first radial frame and the second radial frame, and distributed radially around a circumference of the first radial frame and a circumference of the second radial frame. The radiating elements are connected to the first radial waveguide structure and to the second radial waveguide structure through the second radial frame.

In accordance with yet another embodiment, a method for assembling a dual port waveguide antenna includes encasing a first radial waveguide structure into a first frame, encasing a second radial waveguide structure into a second frame, and connecting a first radio frequency (RF) source coaxial cable to the first radial waveguide structure through the first frame, and a second RF source coaxial cable to the second radial waveguide structure through the second frame. The method further includes connecting a first direct current (DC) switch multi-pin cable to the first radial waveguide structure through the first frame, and a second DC switch multi-pin cable to the second radial waveguide structure through the second frame. A plurality of radiating elements and a plurality of standoffs are also placed between the first frame and the second frame. The radiating elements and the standoffs are radially distributed around a circumference of each one of the first frame and the second frame. The method also includes connecting a base at a surface of one of the first frame opposite to the second frame, and placing a cover over the first frame, the second frames, the radiating elements and the standoffs between the first frame and the second frame.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which:

FIGS. 30A and 30B show an embodiment of a DC logic PIN configuration for a 40 PINs connector for the antenna;

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Disclosed herein are embodiments for an agile antenna that beamsteers wireless transmissions, e.g., RF or microwave signals, by selectively activating/de-activating tunable elements on radial-waveguides using direct current (DC) switches. The antenna is a dual polarized agile antenna comprising two radial waveguides with electronically controlled power dividers and suitable for broadband transmissions, e.g., in the RF or microwave frequency range. As used herein, the term RF frequencies and RF signals is used to represent frequencies and signals, respectively, in the RF, microwave, and other suitable regions of the spectrum for wireless communications.

Figure 1:
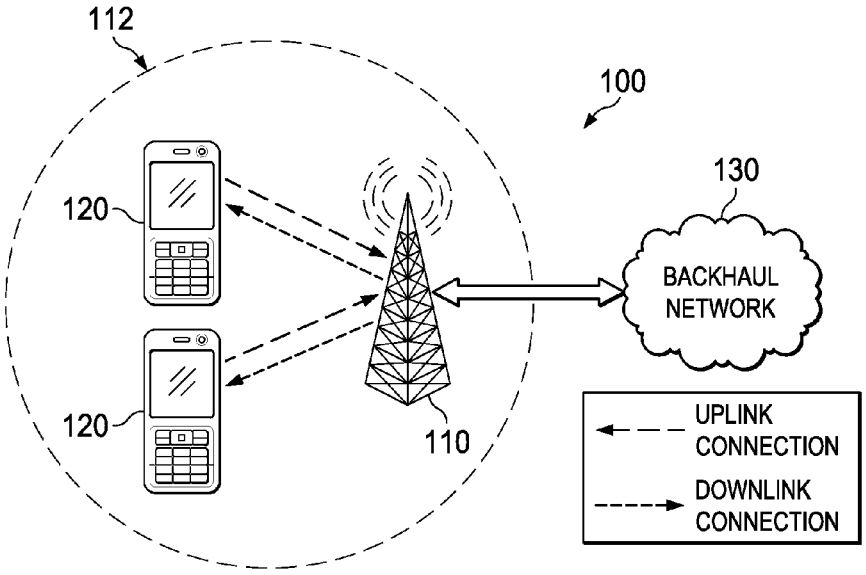
FIG. 1 illustrates a diagram of a wireless network for communicating data.

FIG. 1 illustrates a network 100 for communicating data. The network 100 comprises an access point (AP) 110 having a coverage area 112, a plurality of user equipments (UEs) 120, and a backhaul network 130. The AP 110 may comprise any component capable of providing wireless access, e.g., to establish uplink (dashed line) and/or downlink (dotted line) connections with the UEs 120. Examples of the AP 110 include a base station (nodeB), an enhanced base station (eNB), a femtocell, and other wirelessly enabled devices. The UEs 120 may comprise any components capable of establishing a wireless connection with the AP 110. The backhaul network 130 may be any component or collection of components that allow data to be exchanged between the AP 110 and a remote end (not shown). In some embodiments, the network 100 may comprise various other wireless devices, such as relays, femtocells, etc. The AP 110 or other wireless communication devices of the network 100 may comprise an agile antenna device as described below. The agile antenna is used to transmit/receive the wireless or RF signals with the other devices such as for cellular and/or WiFi communications.

Figure 2:
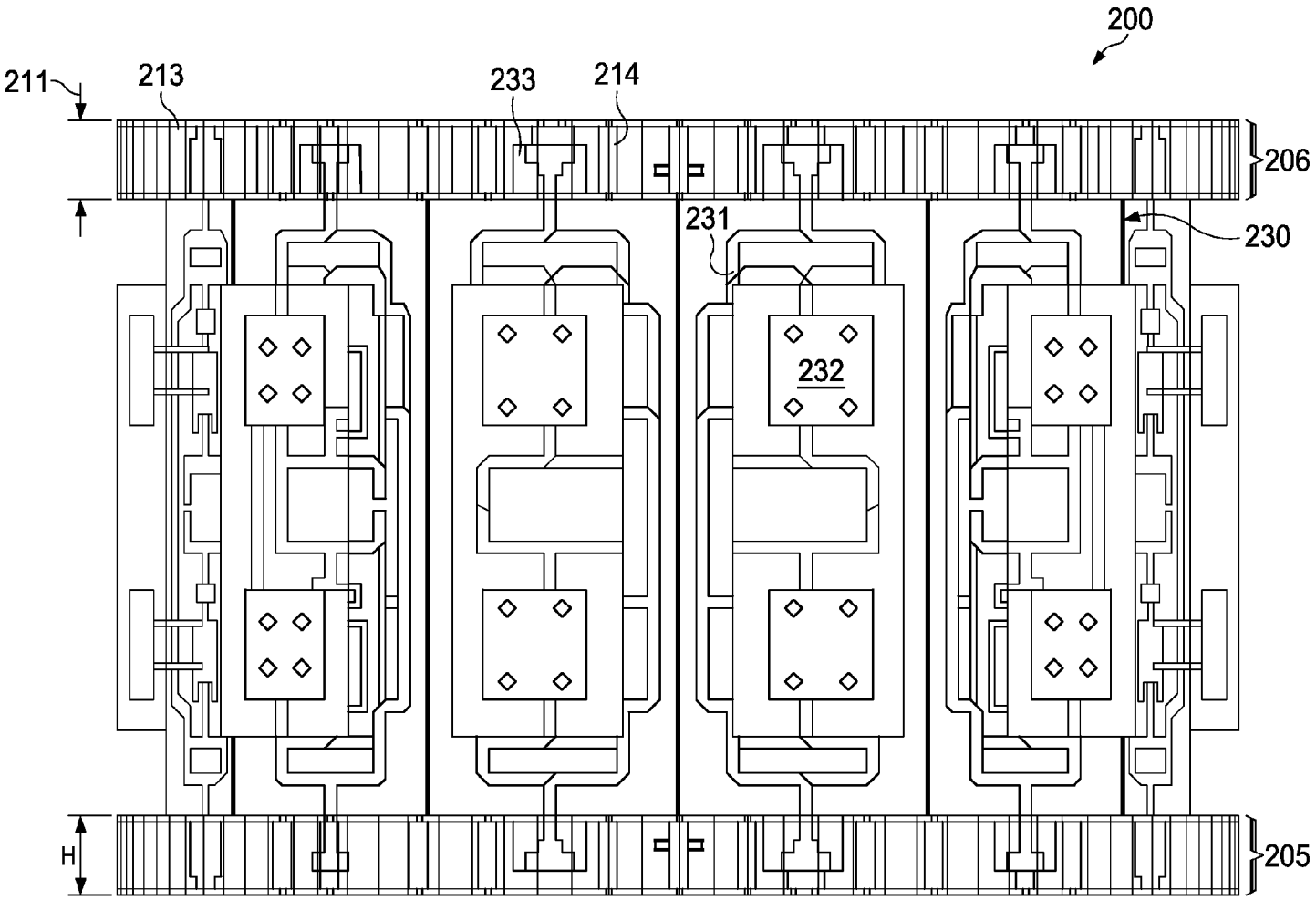
FIG. 2 is a side view of a dual port waveguide antenna according to an embodiment of the disclosure.

FIG. 2 shows an embodiment of a dual polarized agile antenna 200, also referred to herein as a dual port waveguide antenna. The dual port waveguide antenna 200 comprises a first radial waveguide structure 205 (e.g., at the bottom or base of the antenna) and a second radial waveguide structure 206 (e.g., at the top of the antenna), which are similar. Each waveguide structure is composed of two parallel radial surfaces separated from each other by a suitable distance. The parallel radial surfaces/plates 211 are electrically connected via a conductive means 213 forming a short circuit, which reduces radiation loss compared to open circuit. The parallel plates 211 are separated by a predetermined height, H, that promotes broadband operation of the antenna. In an embodiment, the conductive means 213 is a conductive gasket placed around the edges of both plates 211, as described further below. A series of radiating elements 230 is distributed between the first radial waveguide structure 205 and the second radial waveguide structure 206 around the circumference of the two radial waveguides. The radiating elements 230 comprise conductive feed paths 231. Further, a patch 232 is coupled to an outer surface of each radiating element 230. The edges (both bottom and top edges) of the radiating elements 230 form edge probes 233 that electrically connect the radiating elements 230 to the first radial waveguide structure 205 and the second radial waveguide structure 206. The edge probes 233 are part of the radiating elements 230 and printed with the radiating elements 230 in the fabrication process, which simplifies the manufacturing process of the radiating elements 230 and the edge probes 233. Each radial waveguide also includes a series of ground pins 214 between the two surfaces/plates 211. The ground pins 214 are distributed around the circumference of the radial waveguide and close to the edge probes 233 of the radiating elements 230. Each ground pin 214 may be placed about equal distances from an adjacent pair of edge probes 233.

Figure 31:
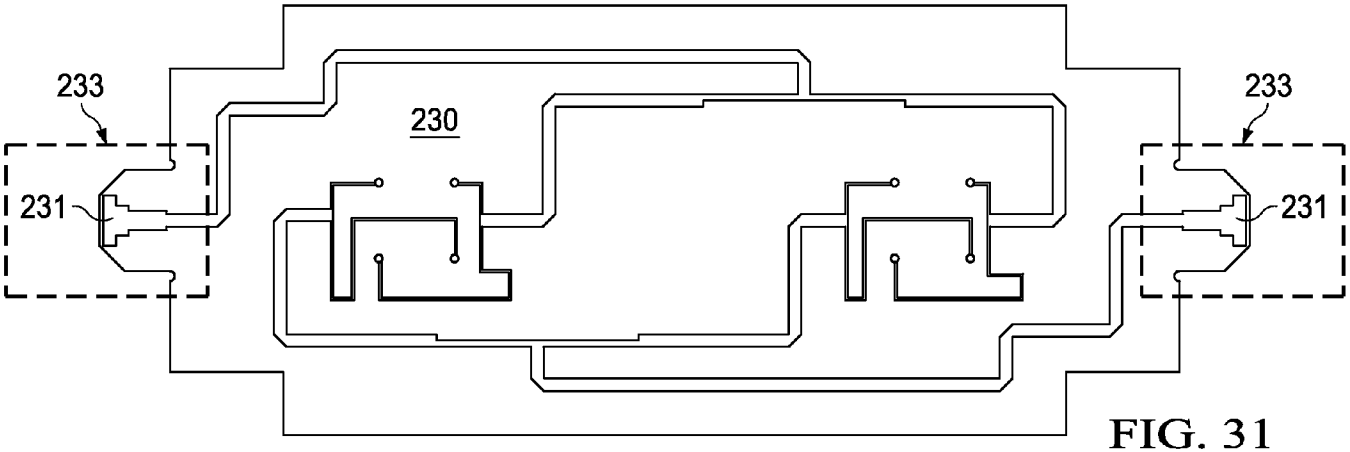
FIG. 31 shows an embodiment of a radiating element of the antenna including edge probes at the ends of the radiating element.
Figure 32:
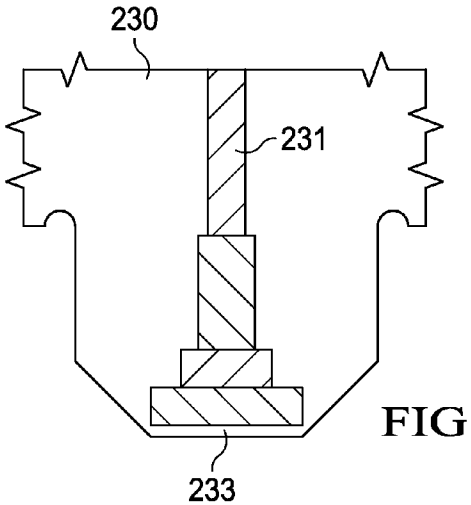
FIG. 32 shows an embodiment of an edge probe and a feed path of a radiating element of the antenna.

FIG. 31 shows an embodiment of the radiating element 230 including integrated edge probes 233 at both ends of the radiating elements 230. The radiating elements 230 including the feed path 231 are fabricated on a printed circuit board (PCB). The PCB is cut in the shape shown in FIG. 31 so that the edges probes 233 have trapezoid like ends. The shape of the probe ends facilitates the assembly of the antenna, as described further below. The shape also includes step wise edges due to cut off corners at each end of the radiating element 230. This provides openings between two adjacent radiating elements and further simplifies the assembly, as described below. The feed path 231 is also shown to extend along the length of the radiating element 230 between the ends of each of the probes 233. Thus, each edge probe 233 becomes part of the feed path 231 as illustrated in FIG. 32 (the shape details of the edge probe 233 are not shown).

Figure 3:
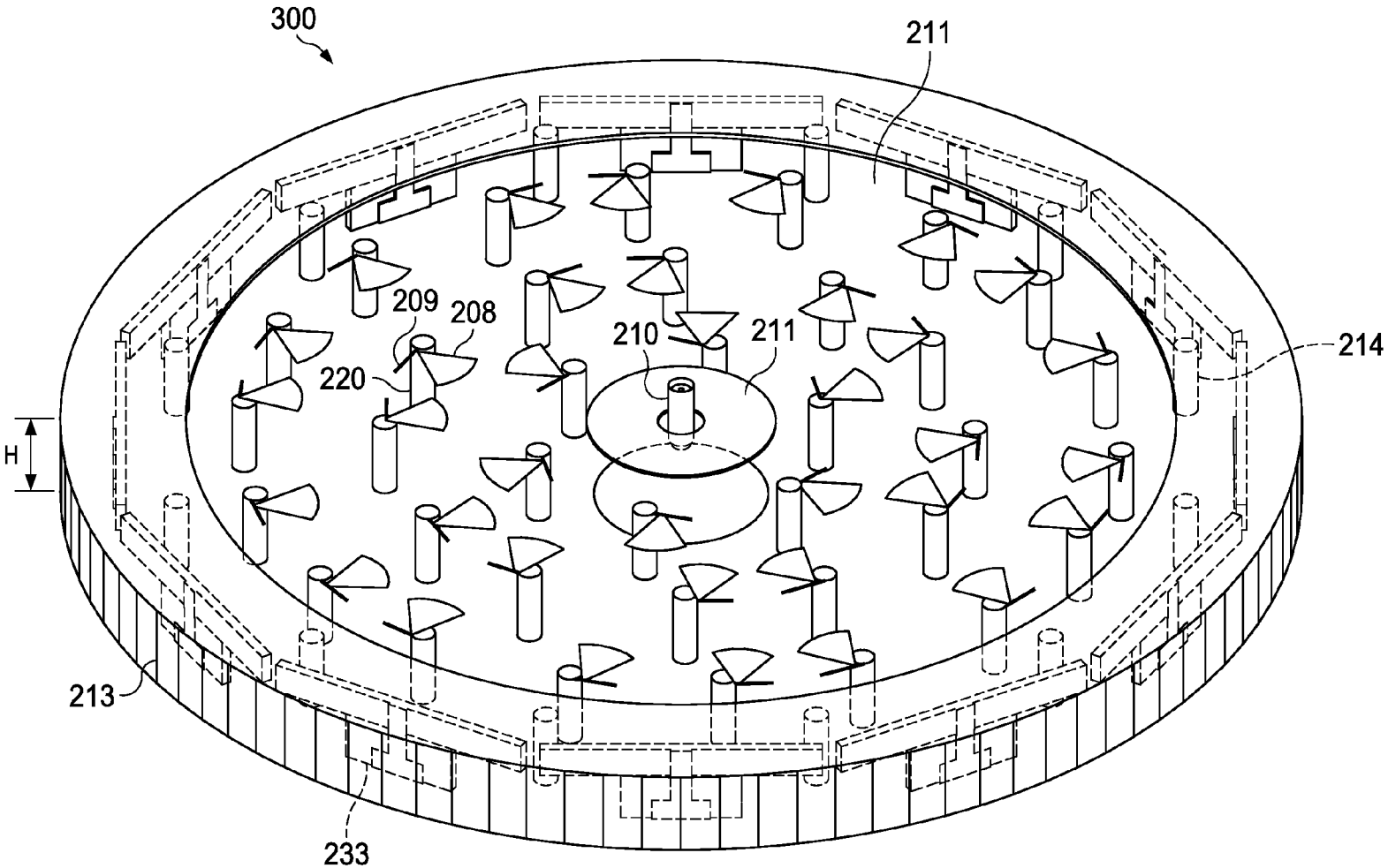
FIG. 3 is an isometric view of a radial waveguide of the dual port waveguide antenna of FIG. 2.

FIG. 3 shows an embodiment of a radial waveguide structure design 300 corresponding to the first radial waveguide structure 205 or the second radial waveguide structure 206. The figure shows the conductive means 213 (e.g., the conductive gasket), portions of the edge probes 233 (at one end of the radiating elements 230), and the ground pins 214. The radial waveguide structure is coupled to a line feed 210 and comprises a plurality of conductive elements 220 connected to tunable elements (PIN diodes or micro-electromechanical systems (MEMS)) and RF chokes 208. The line feed 210 is placed on top of an exposed surface of one of the radial plates 211 (shown partially), at the center of the plate 211. The conductive elements 220 are positioned vertically between the radial plates 211, and interspersed horizontally between the line feed 210 and the radiating elements 230, as shown. The RF choke 208 is connected to an end of the tunable element which is connected to and end of the conductive element 220 via a micro-strip line at the surface/plate 211. The tunable element may be any component or collection of components that has the ability to (collectively or independently) change the flow of current over the radial waveguide structure 205. In an embodiment, tunable elements include tunable elements that rely on a source of energy (e.g., DC power) to change the flow of current, such as (for example) a PIN diode. In the same or other embodiments, tunable elements include electromechanical components that change the flow of current using moving parts or electrical connections, such as (for example) MEMS components.

The RF chokes 208 are connected to tunable elements which are connected to the top of the respective conductive elements 220 by micro-strips 209. The components are designed along with the height H between the plates 211 of the radial waveguide structures 205/206 to allow broadband operation of the antenna. The line feed 210 is coupled to and positioned at the center of one the plates 211 of the radial waveguide structure 300. As such, the line feed 210 provides an electrical signal, which radiates outwardly (e.g., as a RF signal) over the radial waveguide structure 300. The conductive elements 220 are distributed between the radial waveguide surfaces/plates 211, and are interspersed between the line feed 210 and the radiating elements 230 (of which only the edge probes 233 are shown). The tunable elements which are connected to the conductive elements 220 may be selectively activated/deactivated for the purpose of directing propagation of the RF signal towards selected radiating elements 230. As such, the structure with tunable elements and conductive elements 220 act as a power divider which steers the RF beam for wireless transmissions of the antenna. More details regarding the components of the radial waveguide structure 300 are described in U.S. application Ser. No. 13/760,980 filed on Feb. 6, 2013 by Halim Boutayeb and entitled "Electronically Steerable Antenna Using Reconfigurable Power Divider Based on Cylindrical Electromagnetic Band Gap (CEBG) Structure," which is hereby incorporated herein by reference as if reproduced in its entirety.

However, unlike the omni-directional antenna design of the reference application above, the dual port waveguide antenna 200 includes two radial waveguide structures 205 and 206 (or dual polarization ports) that provide increased agility, better power efficiency, and improved interference mitigation. The dual polarization port waveguides are similar, as described above, and can be controlled similarly to achieve matching polarization thereby substantially doubling the radiation power or signal-to-noise ratio and achieving the improvements above. Such antenna can be used for media-based modulation, for example. The dual port waveguide antenna 200 also is capable of providing broadband operation.

Figure 4:
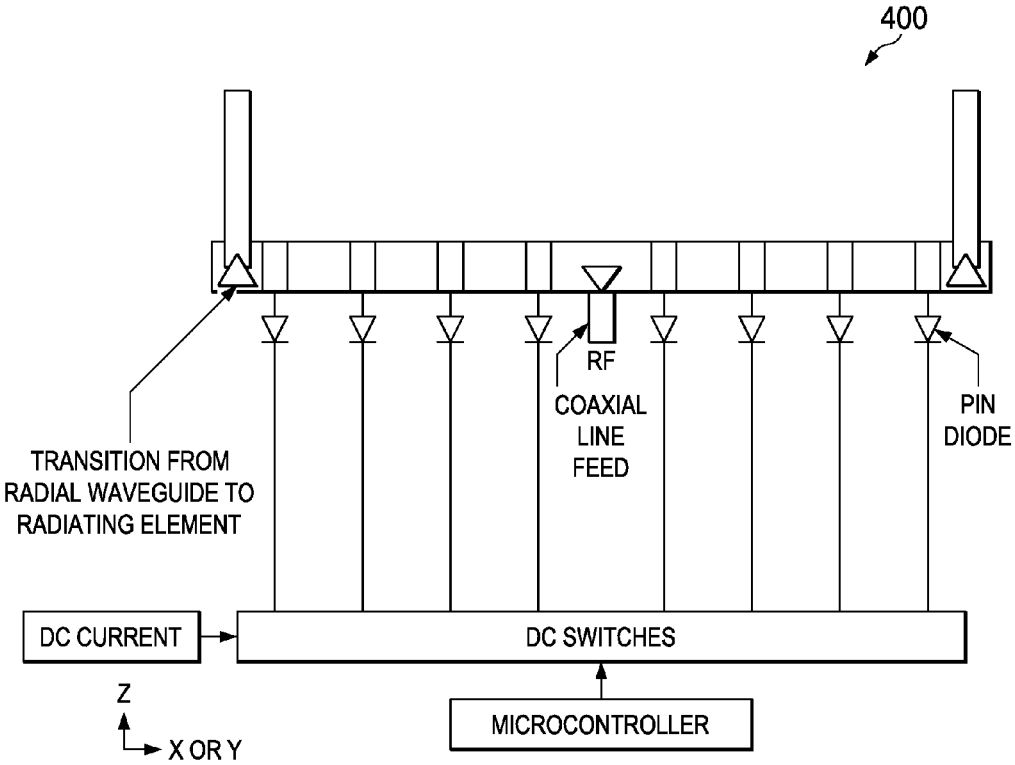
FIG. 4 is a side view of a DC control system for the radial waveguide of the dual port waveguide antenna according to an embodiment of the disclosure.

FIG. 4 shows an embodiment of a DC control system 400 for the radial waveguide of the dual port waveguide antenna. The system 400 utilizes DC switches (driven by DC current) for beamsteering control of the agile antenna. Such control system makes the antenna less complex than conventional agile antennas (which rely on phase shifters and RF switches to effectuate beamsteering). As shown, a group of diodes (PIN diodes) are controlled by a microcontroller via a series of DC switches. The beamsteering related processing in the agile antenna is based on manipulating the group of PIN diodes, and therefore may be far less complex than the baseband processing (e.g., computing phase/amplitude shifts, etc.) inherent to conventional agile antennas. The microcontroller may be of lower complexity and consumes less power than the processors included in conventional agile antenna designs. Also shown is a coaxial line feed at the center of the radial waveguide. The coaxial line feed is connected to a RF signal source (not shown).

Figure 5:
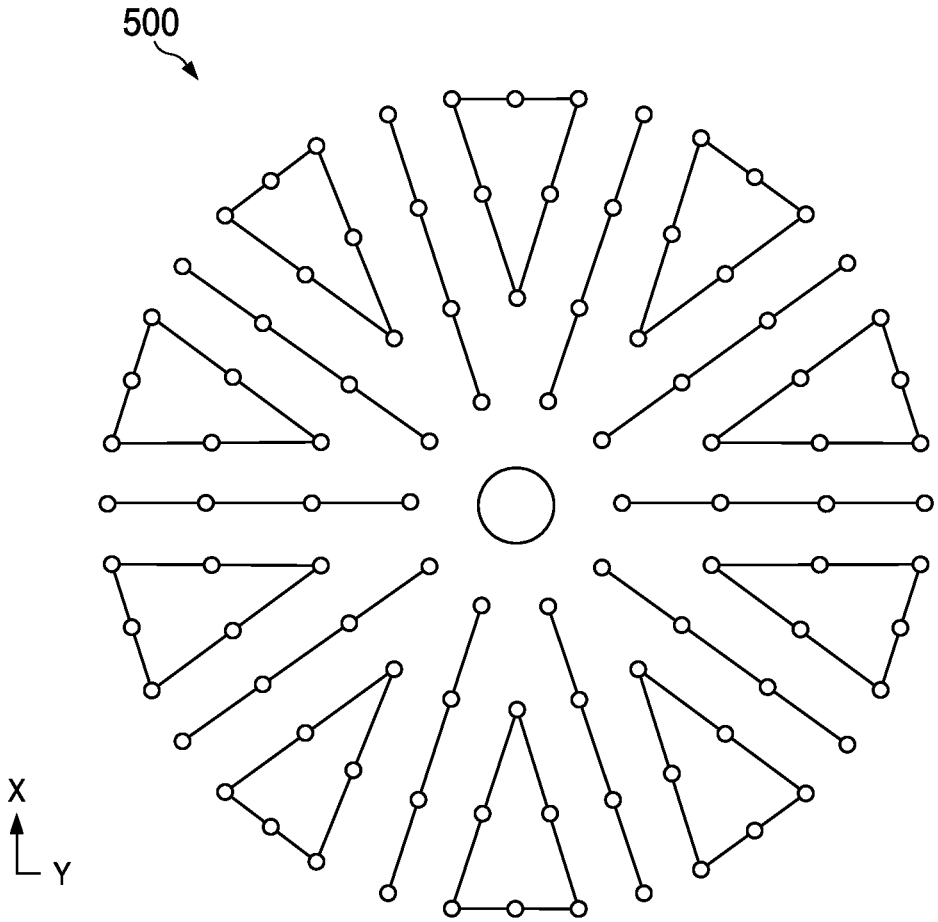
FIG. 5 is a top view of groups of tunable elements in the radial waveguide of the dual port waveguide antenna according to an embodiment of the disclosure.

In some configurations, the number of DC switches required to effectuate beamsteering is reduced by using a common switch to activate groups of tunable elements. FIG. 5 shows groups of tunable elements in the agile antenna 200 can be controlled by a common switch. The groups of tunable elements (as indicated by the lines) are controlled by the same switch such that fewer switches (e.g., twenty switches in FIG. 6) are used to control beamsteering.

Figure 6:
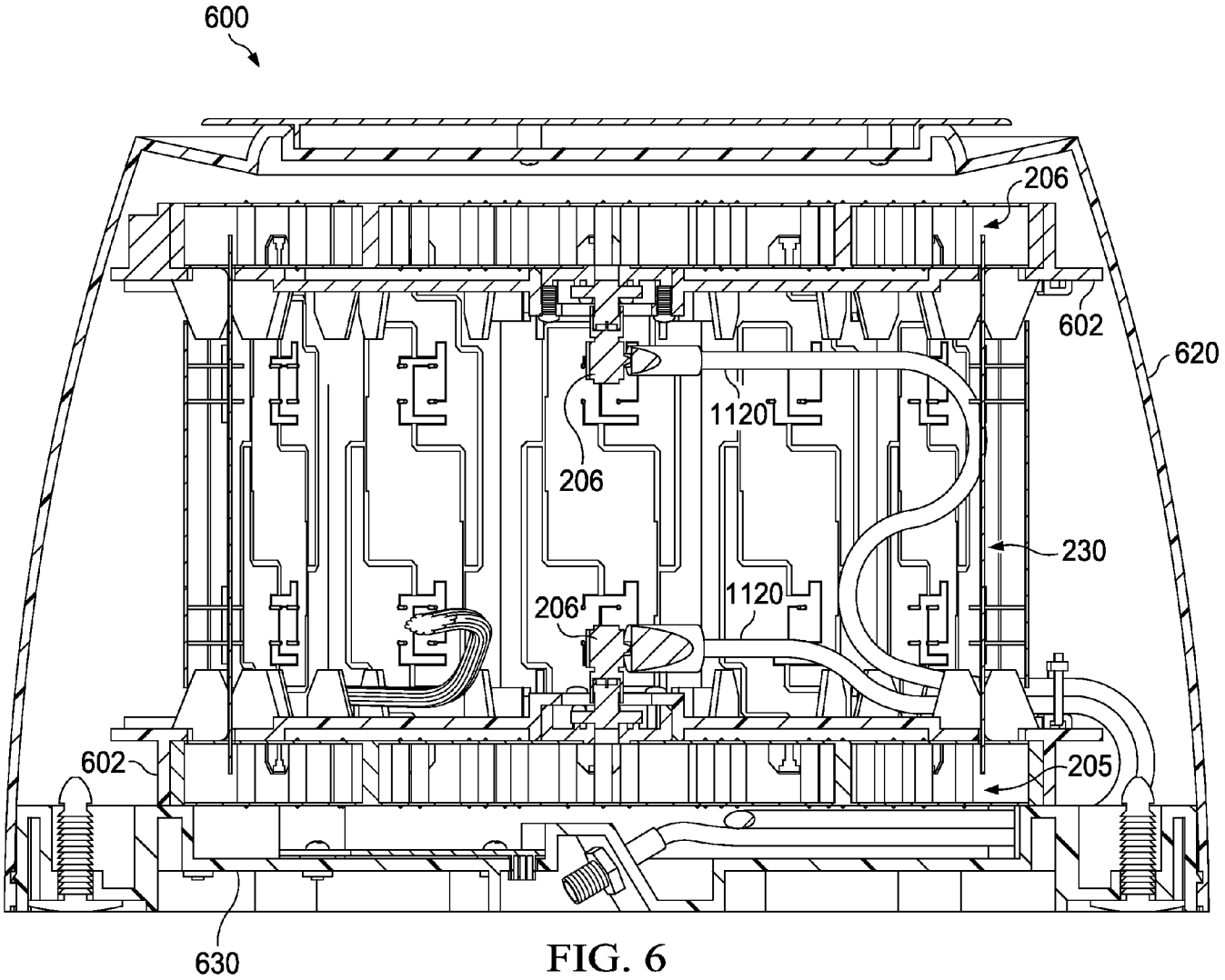
FIG. 6 is a side cross-section view of an antenna assembly of the dual port waveguide antenna according to an embodiment of the disclosure.
Figure 7:
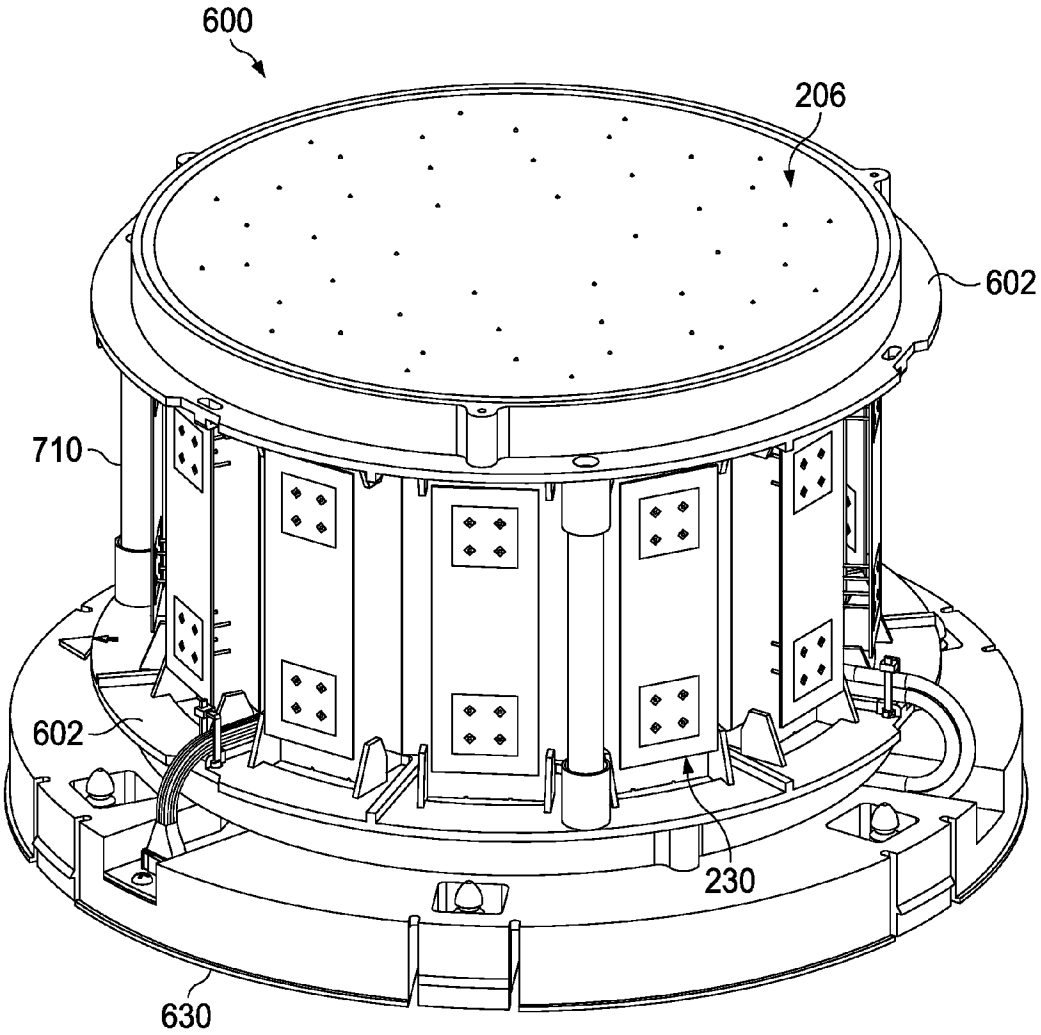
FIG. 7 is an isometric view of the antenna assembly of FIG. 6.
Figure 8:
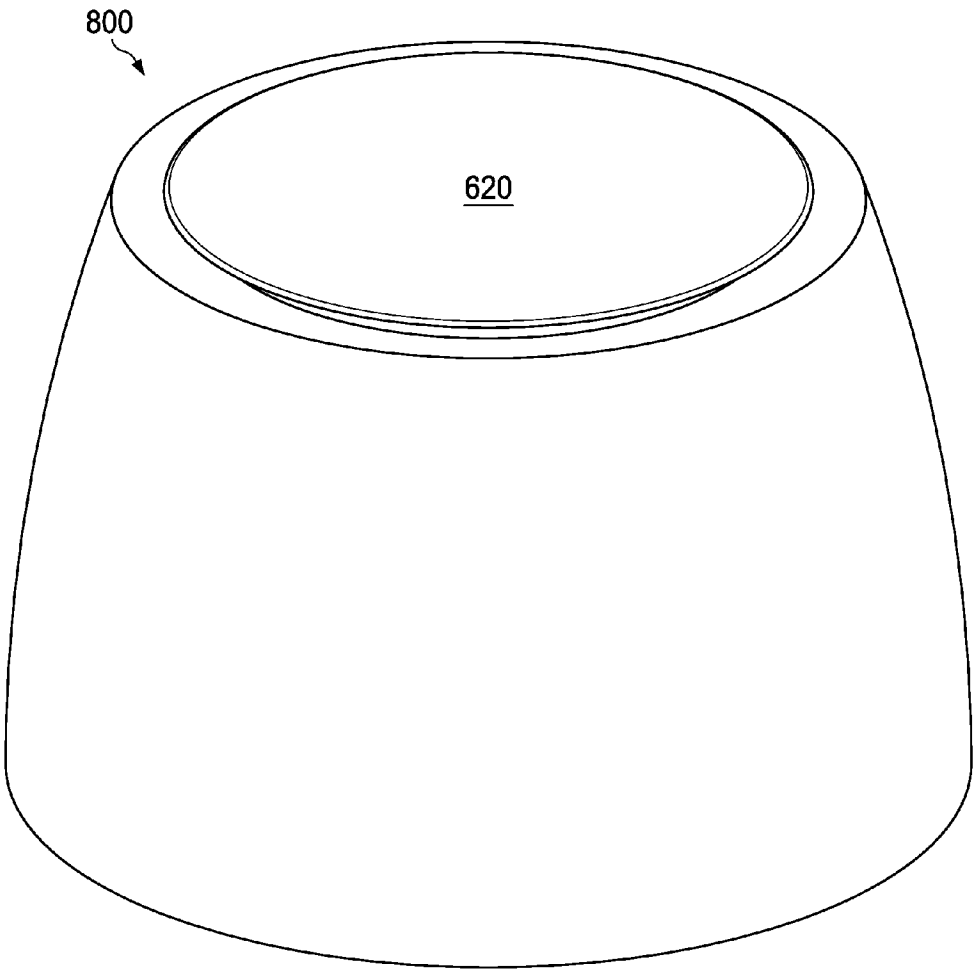
FIG. 8 is an isometric view of a cover of the antenna of FIG. 6.

FIG. 6 shows an embodiment of an antenna assembly 600 of the dual port waveguide antenna. The assembly 600 includes a cover 620 enclosing the radial waveguide structure 205 and 206 and the radiating elements 230 between them. The assembly 600 also includes a frame 602 for each waveguide structure. The frames 602 hold the corresponding waveguide structure at the top and bottom of the antenna. The bottom waveguide structure 205 in the frame 602 is placed on a base 630. Also shown are the line feeds 210 of the radial waveguide structure 205 and 206. The line feeds face each other are connected to respective coaxial or SMA cables 1120, as described further below. FIG. 7 is another view of the antenna assembly 600 further showing a series of round standoffs 710, e.g., nylon standoffs, distributed around the antenna between the top and bottom frames 602. The round standoffs 710 serve to hold the frames together and hold the remaining components between them. FIG. 8 shows the cover 620 which has a cylindrical like form. Other forms can also be used, such as a dome like (e.g., radome shaped) cover or variations thereof.

Figure 9:
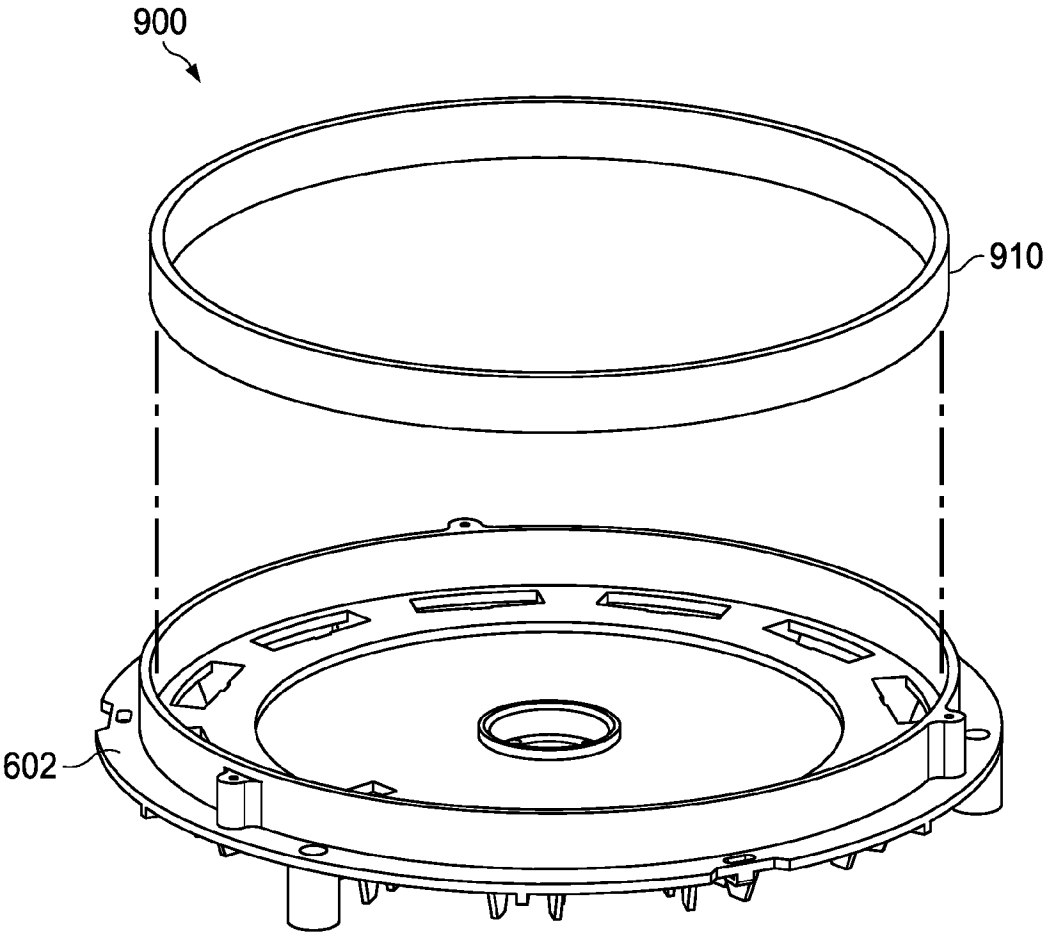
FIG. 9 is an isometric view of a frame assembly of FIG. 6.
Figure 10:
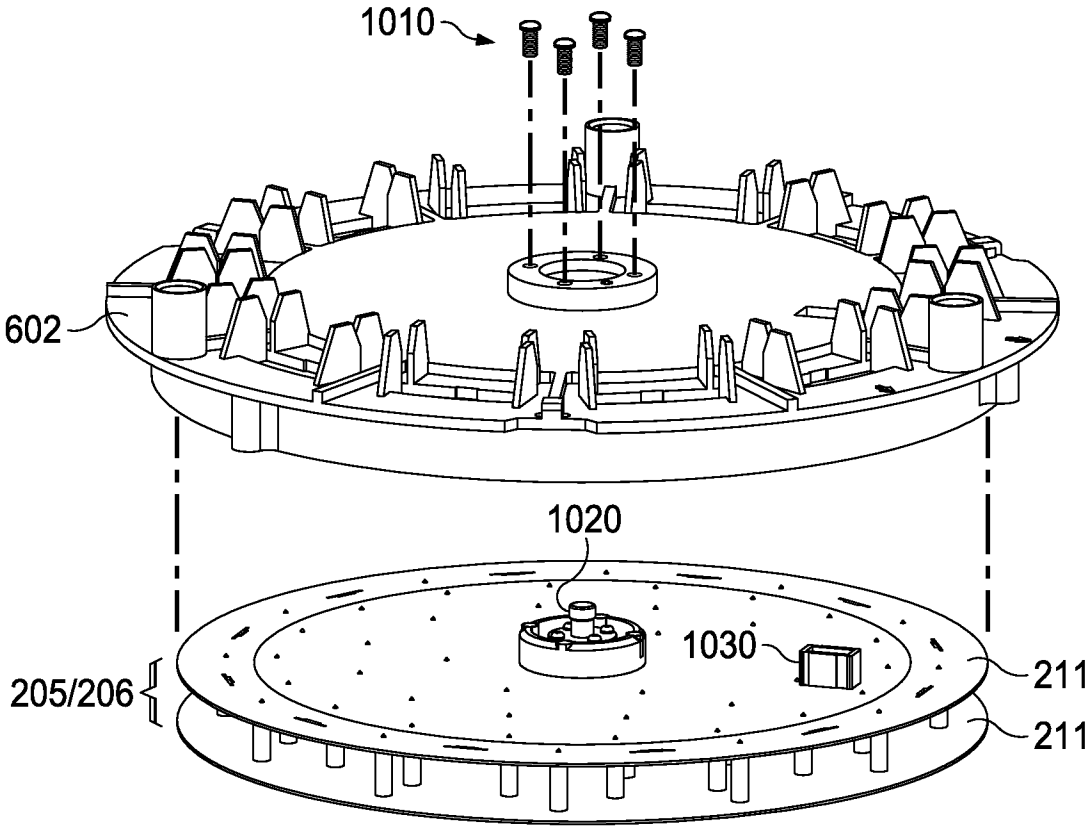
FIG. 10 is an isometric view of further components of the frame assembly of FIG. 6.

FIG. 9 shows a frame assembly 900 for the antenna assembly 600. The frame assembly 900 includes a conductive gasket 910 positioned around the inside wall of the radial frame 602. When the radial waveguide structure 205 or 206 is placed inside the frame 602, the conductive gasket 910 comes in contact with and electrically connects the two surfaces 211 of the radial waveguide structure 205 or 206. FIG. 10 shows assembling the frame 602 with the radial waveguide 205 or 206, via a plurality of screws 1010 (e.g., four metal screws as shown). The assembly of the frame 602 is similar for both radial waveguides 205 and 206. A RF connector (SMA connector) 1020 and a multi-pin connector 1030 are also connected to the surface 211 facing the frame 602.

Figure 11:
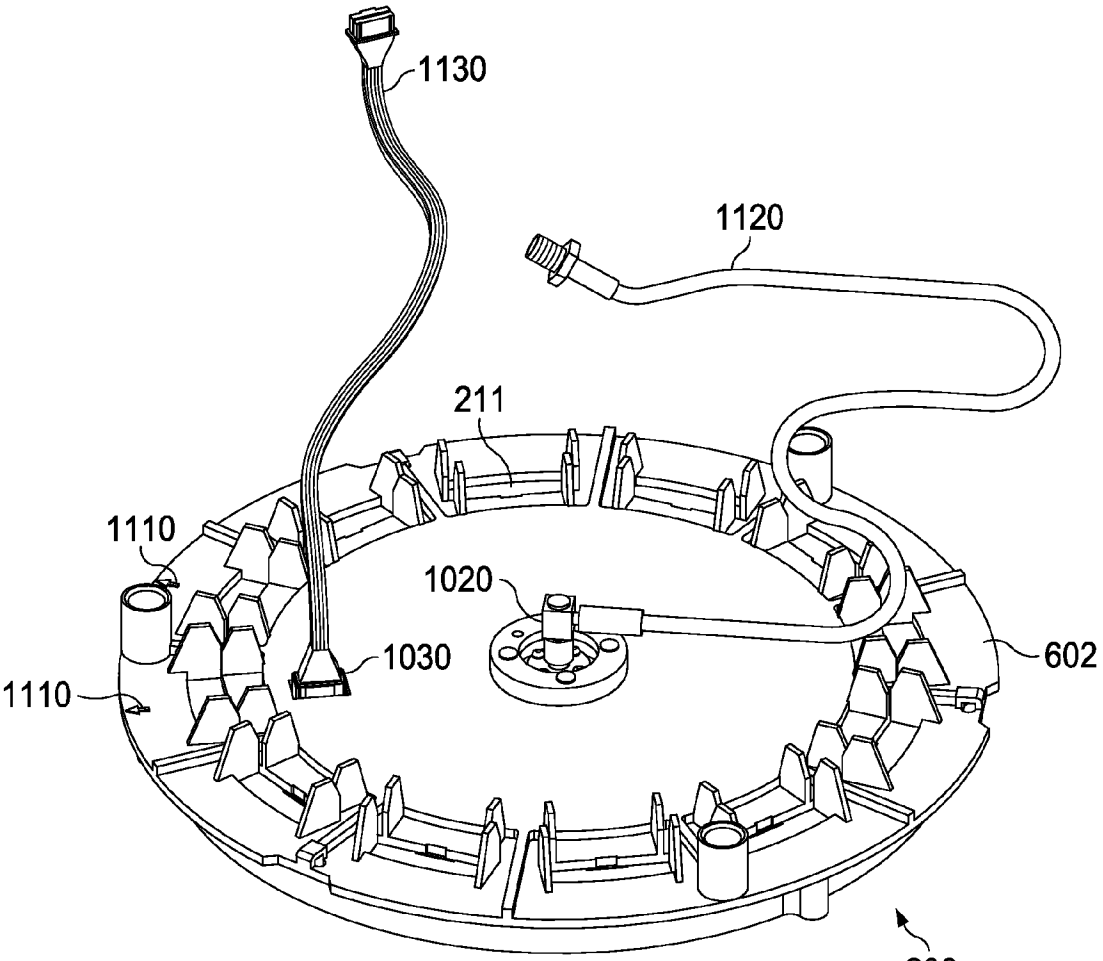
FIG. 11 is an isometric view of further components of the frame assembly of FIG. 6.

FIG. 11 shows further components of the assembly of the top frame 602 comprising the top radial waveguide structure 206. When the radial waveguide structure 206 is inserted inside the frame 602, the SMA connector 1020 and the multi-pin connector 1030 are exposed through corresponding openings in the frame 602. This allows the connection of a SMA cable 1120 to the SMA connector 1020 and the connection of a multi-pin cable 1130 to the multi-pin connector 1030 through the frame 602. The SMA cable 1120 is used to provide an electrical signal to the line feed 210. The electrical signal is converted by the line feed 210 into a RF wireless signal. The multi-pin cable 1130 is used to provide the control to the PIN diodes, e.g., from a microcontroller via a series of DC switches. One or more markers 1110 are also placed on the exposed surface of each frame 602 in order to facilitate aligning the two facing frames 602 with each other during the assembly. The markers 1110 are part of the frame structure 602, and are realized on the surface of the frame 602 during the fabrication (e.g., molding) of the frame.

Figure 12:
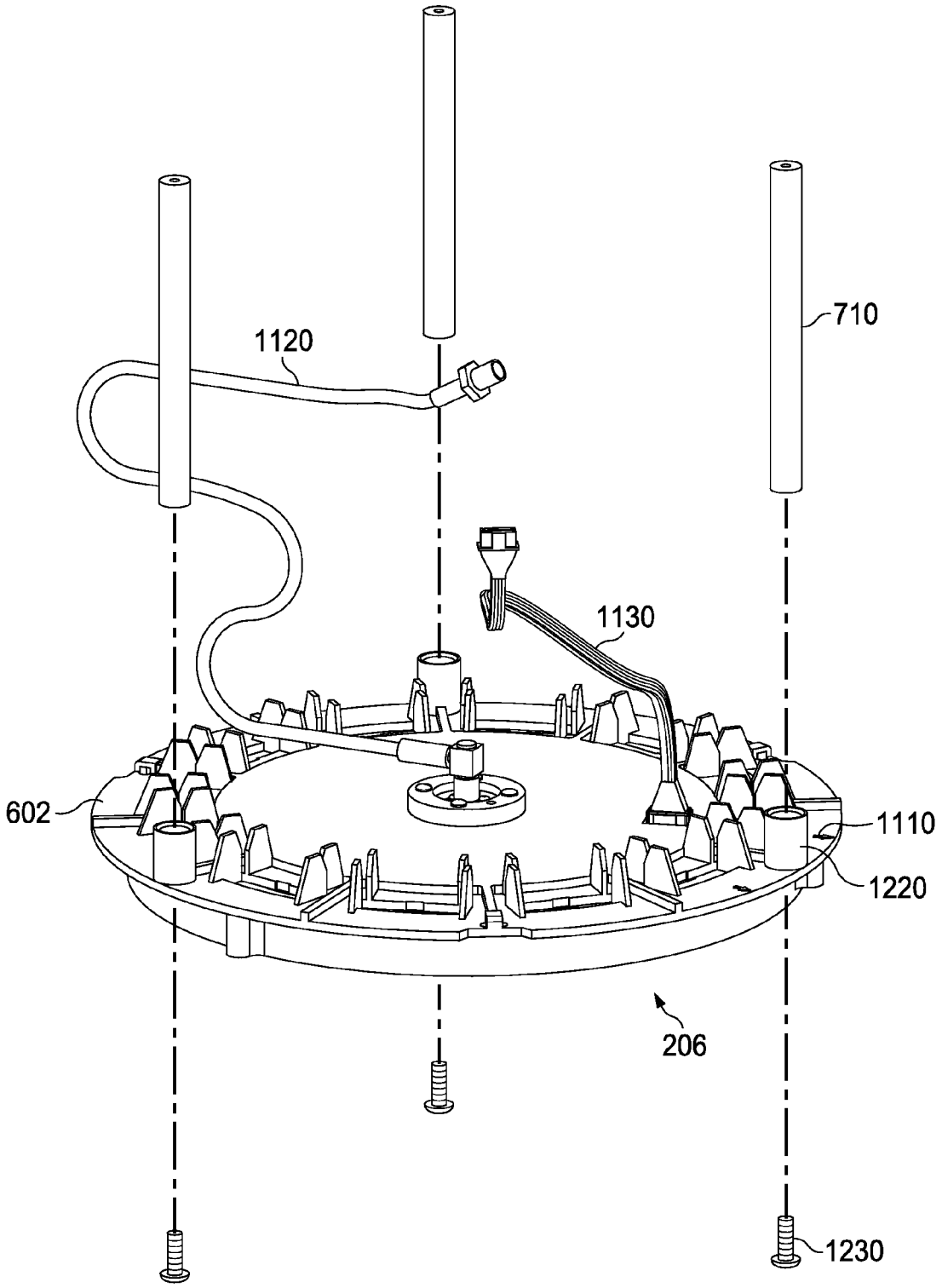
FIG. 12 is an isometric view of further components of the antenna assembly of FIG. 6.
Figure 13:
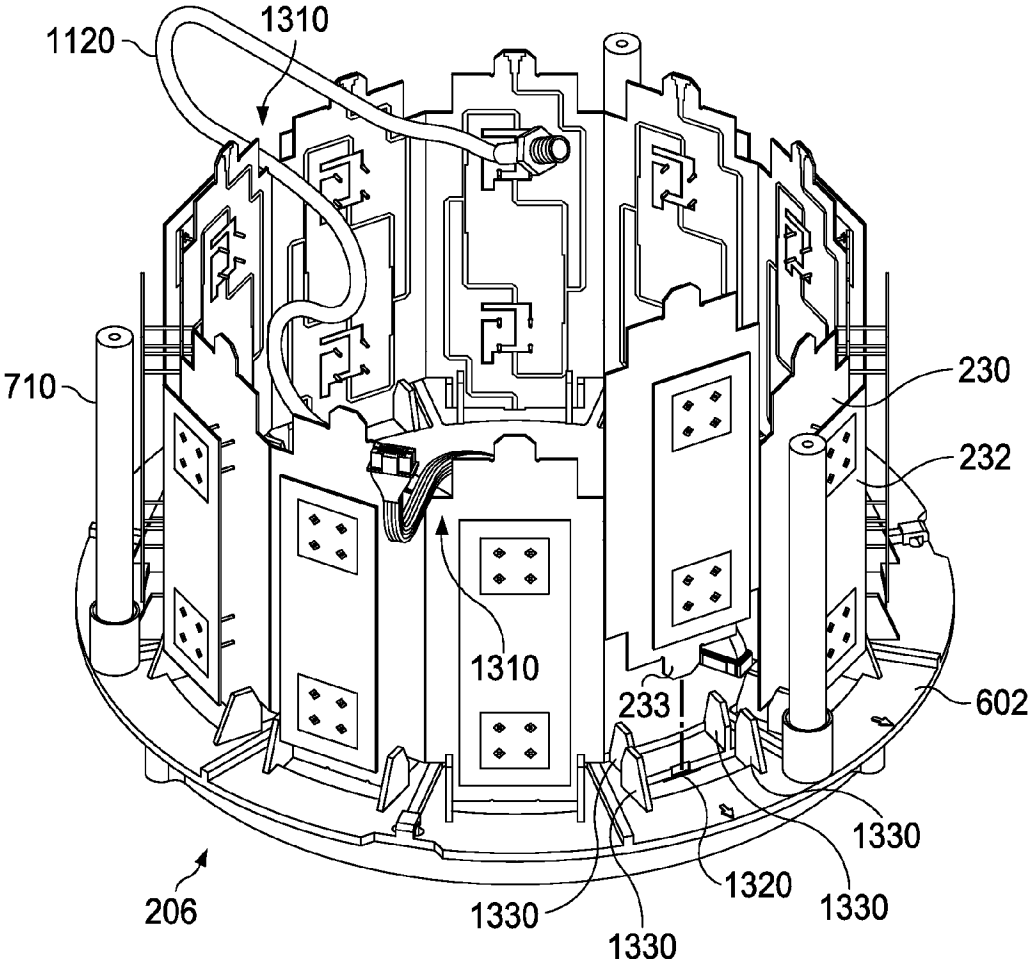
FIG. 13 is an isometric view of further components of the antenna assembly of FIG. 6.

FIG. 12 shows the placing of the round standoffs 710 in the top frame 602 comprising the top waveguide structure 206. Each standoff 710 is affixed into a corresponding cylindrical holder 1220 protruding at the edge of the frame 602 by a screw 1230 inserted from the opposite side of the frame 602. The cylindrical holders 1220 are part of the frame 602 structure. FIG. 13 shows the placing of the radiating elements 230 on the top frame 602. Although shown in the bottom of the FIG. 13, the frame 602 will represent the top frame at the end of the assembly process, as shown further below. The radiating elements 230 are inserted into corresponding slots 1320 and between guide ribs 1330 around the circumference of the frame 602. Specifically, the edge probes 233 of the radiating elements 230 are inserted into the slots 1320. The guide ribs 1330 are positioned next to both edges of each slot 1320, and serve to hold the radiating elements 230 vertically. The slots 1320 and guide ribs 1330 are part of the frame 602. The edge probes 233 are designed, as shown in FIGS. 31 and 32, during the fabrication process to obtain a probe geometry with trapezoid like ends that facilitate the insertion of the radiating elements into the slots 1320. The radiating elements 230 are also designed as shown in FIG. 31 with cut off corners producing step wise edges which facilitate the alignment of the radiating elements 1320 and provide an opening 1310 between each adjacent pair of inserted radiating elements 230. The SMA cable 1120 and the multi-pin cable 1130 are then passed through two of the openings 1310 as shown. Two specific openings can be chosen to align with fastener loops 1410 for tying the cables as described below.

Figure 14:
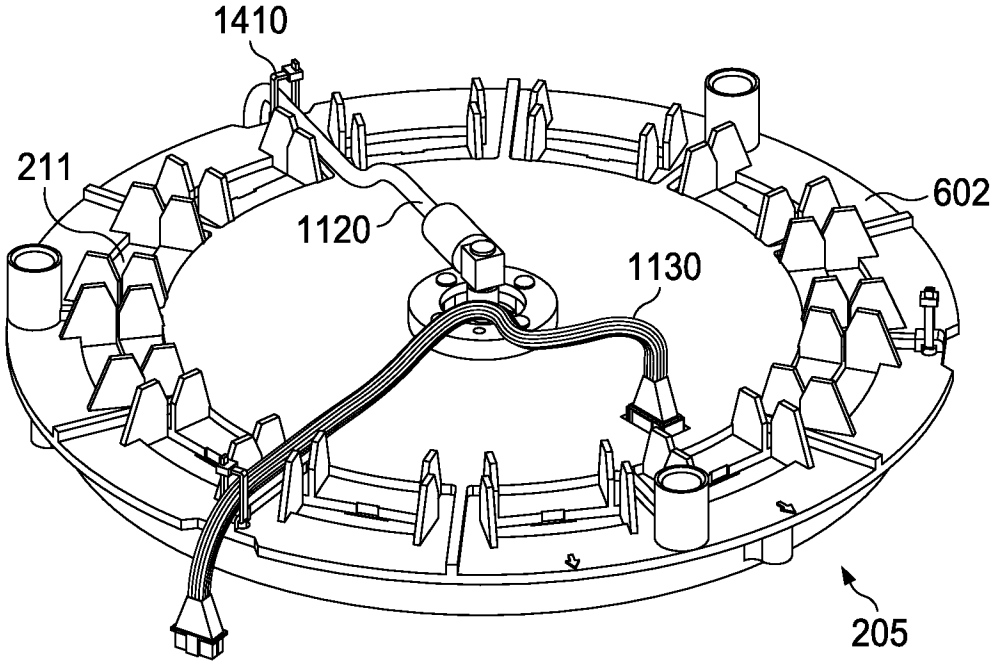
FIG. 14 is an isometric view of a second frame assembly of FIG. 6.

FIG. 14 shows the assembly of a bottom frame 602 to the bottom radial waveguide structure 205. The bottom waveguide structure 205 is placed in the frame 602 as shown in FIGS. 9 to 10 above. The SMA cable 1120 and the multi-pin cable 1130 protruding from the bottom waveguide structure 205 through the bottom frame 602 are loosely fastened at the edge of the frame 602 via corresponding fastener loops 1410 that are wrapped around the respective cables and attached to the surface of the frame 602. As such, the cables can extend outside the bottom frame 602 and closely wrap around the frame 602's surface and edge.

Figure 15:
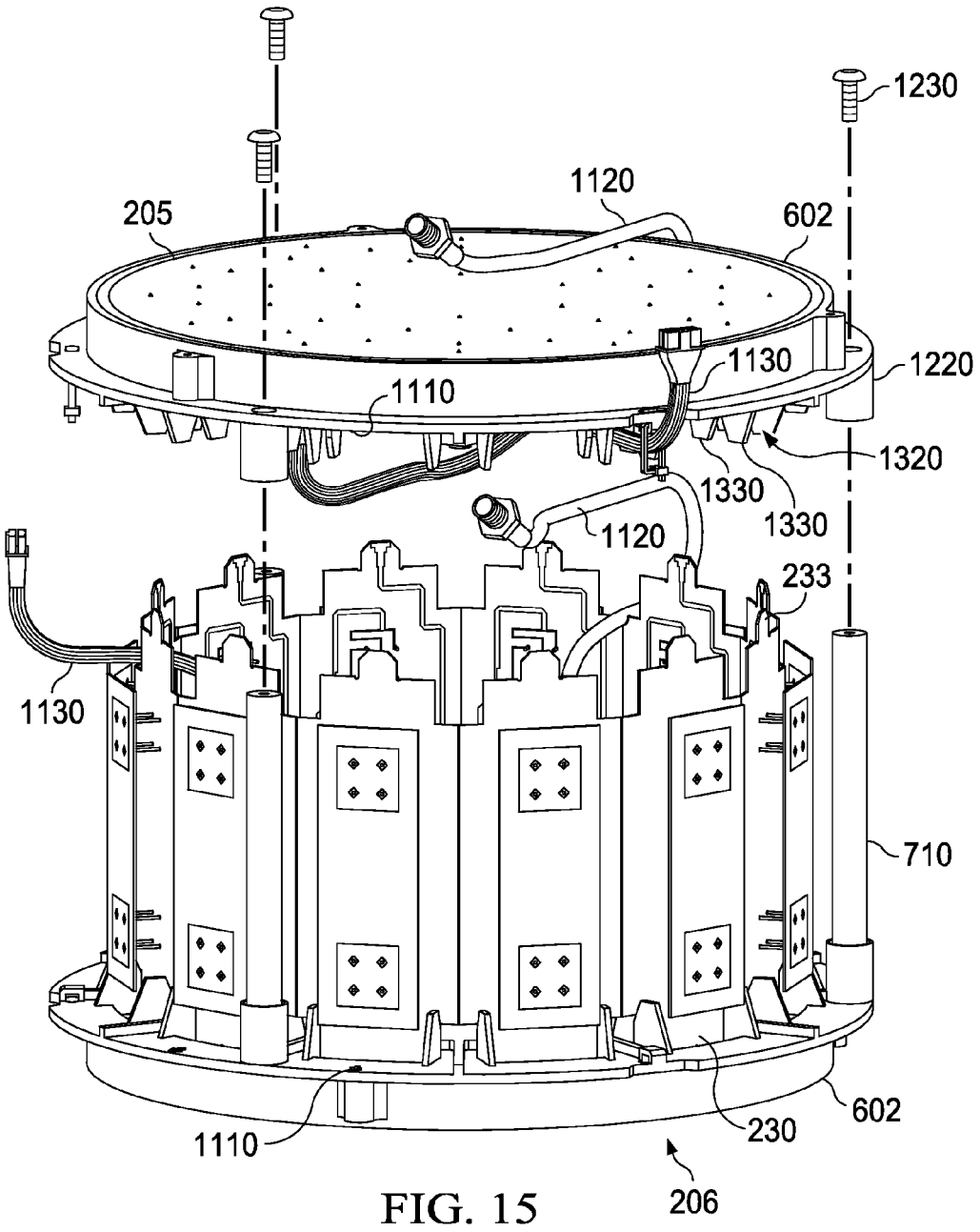
FIG. 15 is an isometric view of further components of the antenna assembly of FIG. 6.

FIG. 15 shows the placing of the bottom frame 602 comprising the bottom waveguide structure 205 on the assembled components of FIG. 13. The bottom frame 602 is shown at the top of the FIG. 15 in an intermediate assembly step where the antenna assembly 600 is held upside down to simplify the assembly process. The bottom frame 602 is rotated to align properly with the top frame 602 (comprising the top waveguide structure 206) by aligning the one or more markers 1110 on the edges of the two frames 602 with each other. To place the bottom frame 602, the standoffs 710 previously affixed to the top frame 602 (in FIGS. 12 and 13) are inserted into respective cylindrical holder 1220 of the bottom frame 602 and affixed via respective screws 1230. The exposed edge probes 233 at the end of the radiating elements 230 are inserted into respective slots 1320 in the bottom frame 602 and the sides of the radiating elements 230 are slid between the guide ribs 1330 of the bottom frame 602. The guide ribs 1330 and the cut corners on both sides at end of the radiating elements 230 serve to create a self-aligning structure which makes assembly easier. As shown, the SMA cables 1120 and the two multi-pin cables 1130 of the two frames 602 are extended outside the assembled antenna (close to the bottom frame 602) between adjacent pairs of radiating elements 230.

Figure 16:
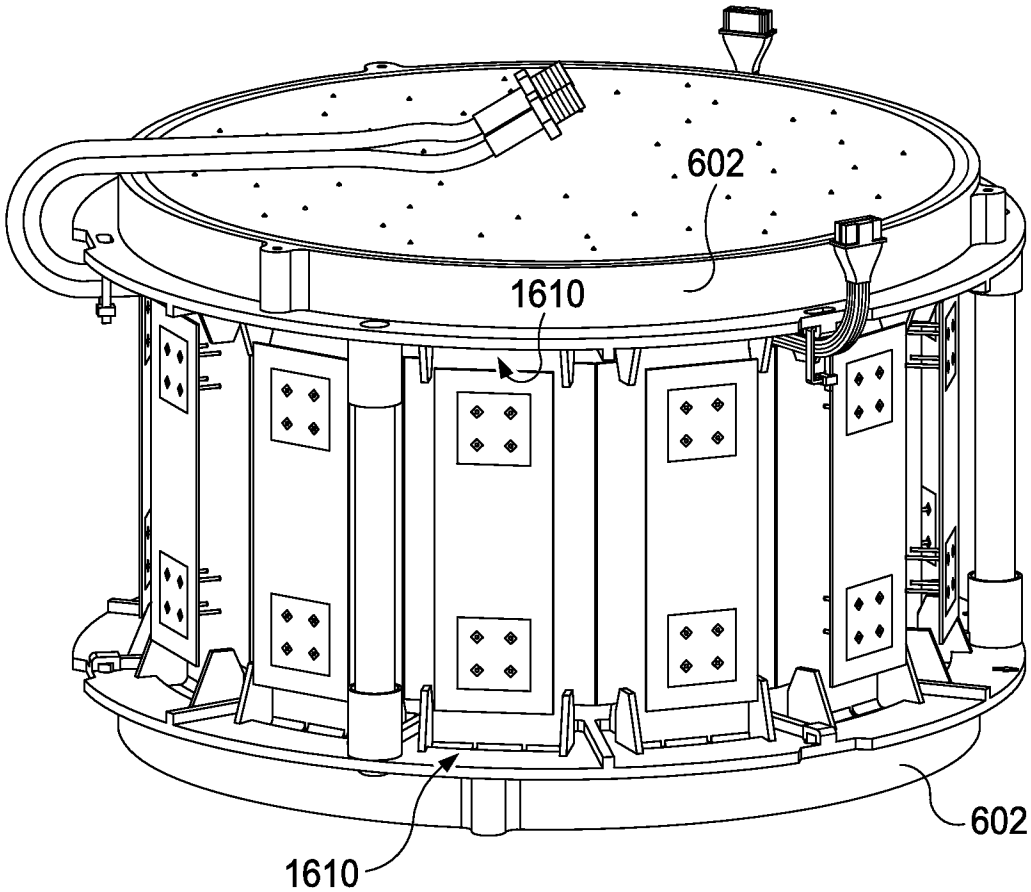
FIG. 16 is an isometric view of further components of the antenna assembly of FIG. 6.

FIG. 16 shows the placing of solder elements 1610 around the slots 1320 and at the junctions of the radiating elements 230 and the ground plane side of a parallel plate 511 at the bottom side of the bottom radial waveguide structure 206 after the assembly in FIG. 15. The solder elements 1610 serve to electrically connect the radiating elements 230 to the bottom plane 511.

Figure 17:
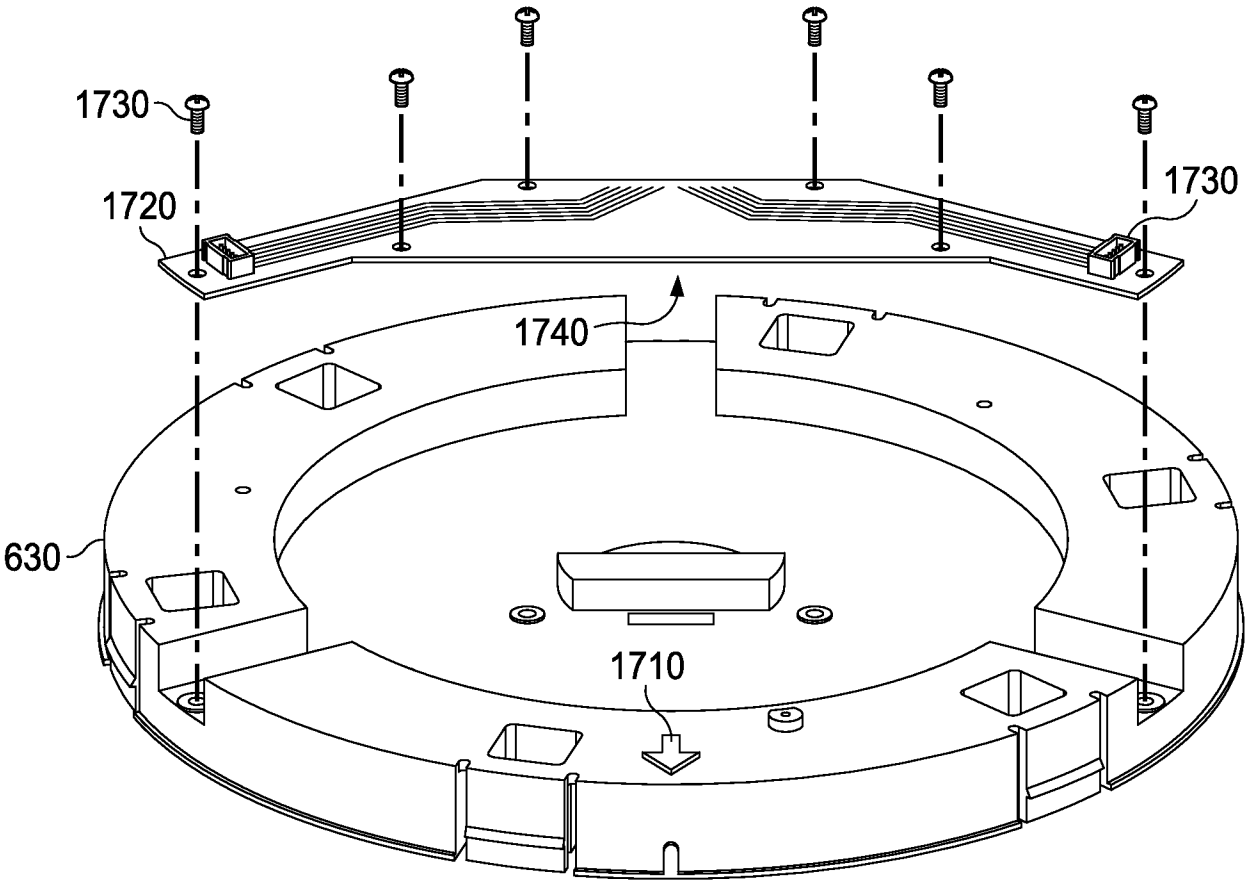
FIG. 17 is an isometric view of a base assembly of FIG. 6.
Figure 18:
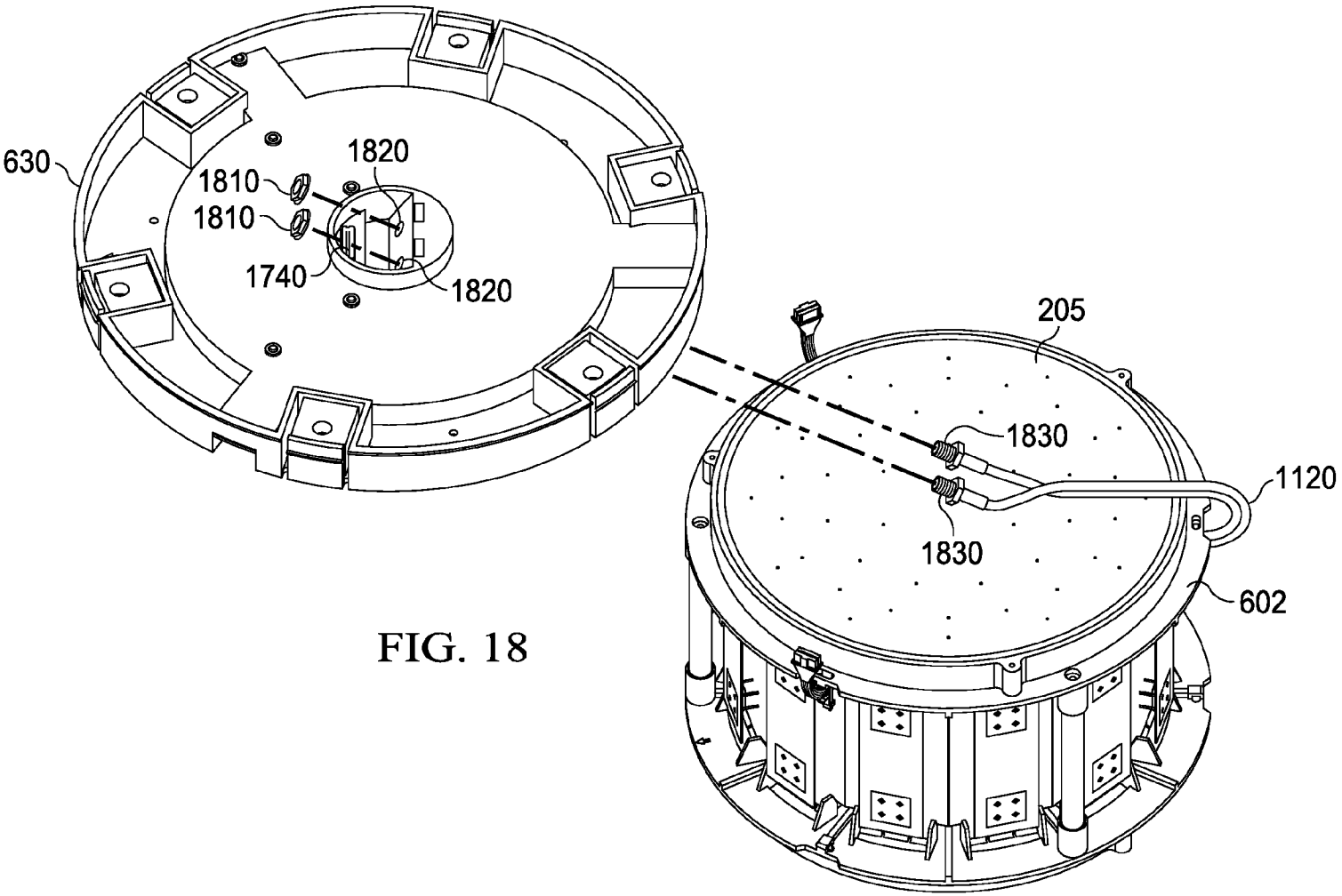
FIG. 18 is an isometric view of further components of the base assembly of FIG. 6.
Figure 19:
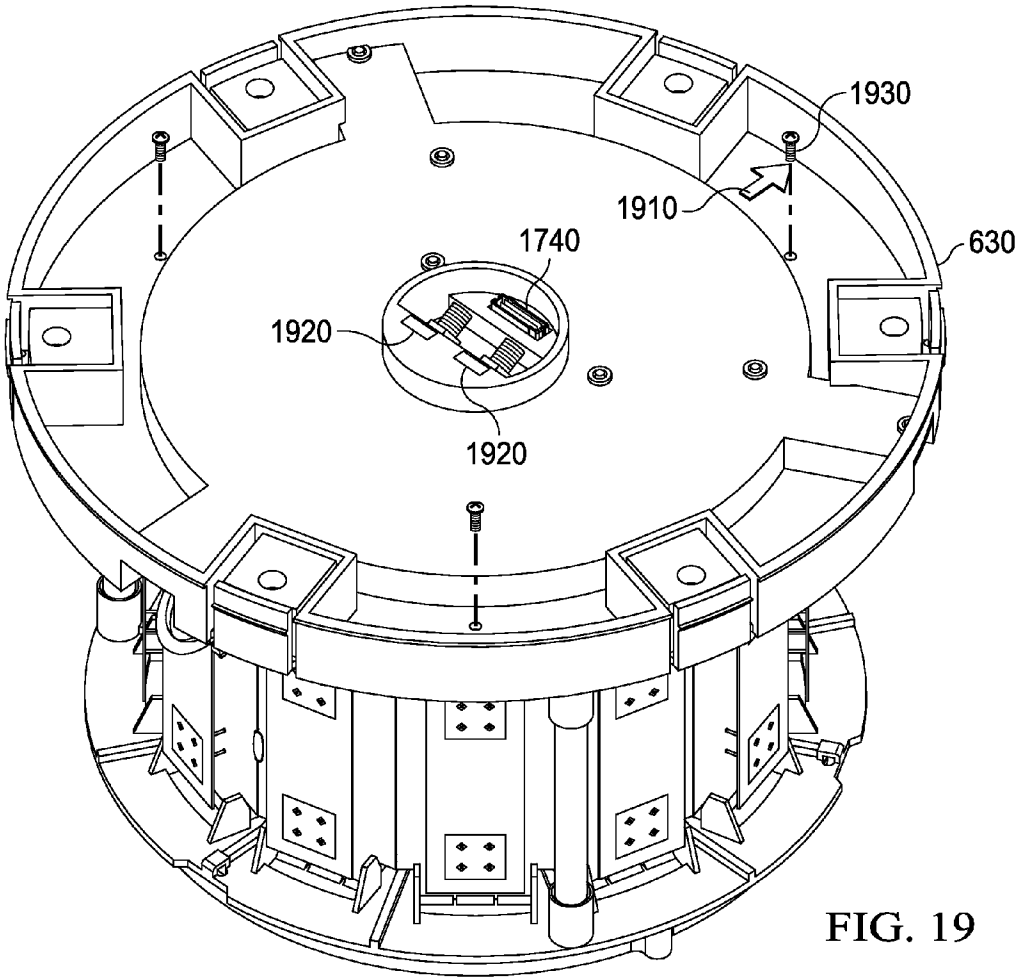
FIG. 19 is an isometric view of further components of the base assembly of FIG. 6.
Figure 20:
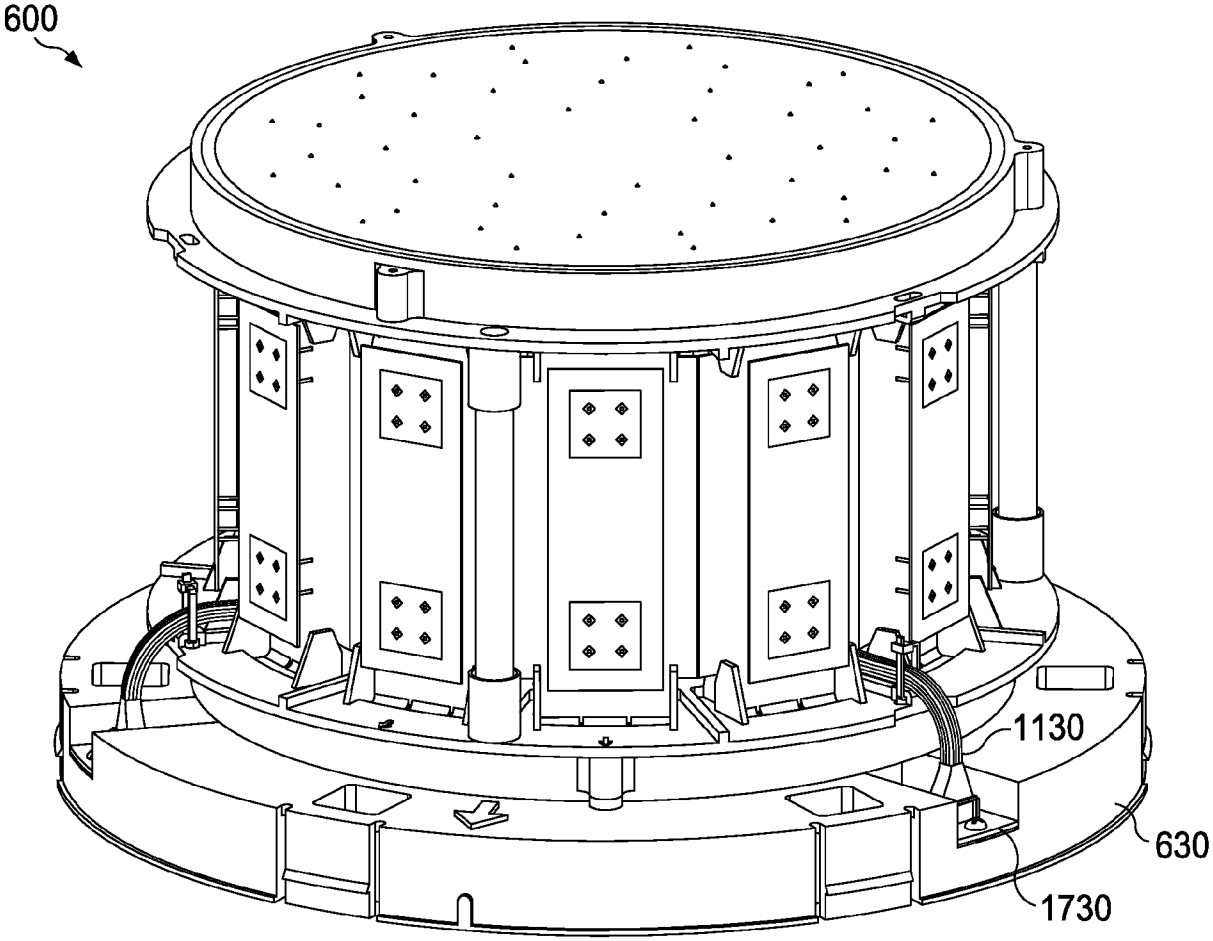
FIG. 20 is an isometric view of further components of the antenna assembly of FIG. 6.

FIG. 17 shows the assembly of the base 630. A connector board 1720 is placed on the base 630 and fixed via a plurality of screws 1730. The connector board 1720 includes to edge connectors 1730 on one surface (top surface) and a center bottom connector 1740 (shown in FIG. 18) on the opposite surface (bottom surface). A base marker 1710, which is part of the surface of the base 630, is used to orient the connector board 1720 properly on the base 630. FIG. 18 shows the placing of the base 630 onto the bottom frame 602 (comprising the radial waveguide structure 205). Further, the ends 1830 of the two SMA cables 1120, which protrude from the antenna assembly, are inserted into two respective openings 1820 in the base 630. The ends 1830 comprising threads are then affixed in the openings 1820 via respective nuts 1810. FIG. 19 shows the assembly at the bottom surface of the base 630. A second base marker 1910 is used to align the base 630 properly with the bottom frame 602. The base 630 is fixed to the bottom frame 602 (not shown) via a plurality of screws 1930. The openings for the ends 1830 are labeled by corresponding labels 1920 that distinguish between the SMA cables of the bottom radial waveguide structure 205 and the radial waveguide structure 206. FIG. 20 shows the resulting antenna assembly 600. The ends of the multi-pin cables 1130, which protrude from the antenna assembly 600, are fixed to the base 630 via respective edge connectors 1730. Thus, the multi-pin cables 1130 and the SMA cables 1120 are ready to be connected to corresponding control systems from the bottom surface side of the base 630.

Figure 21:
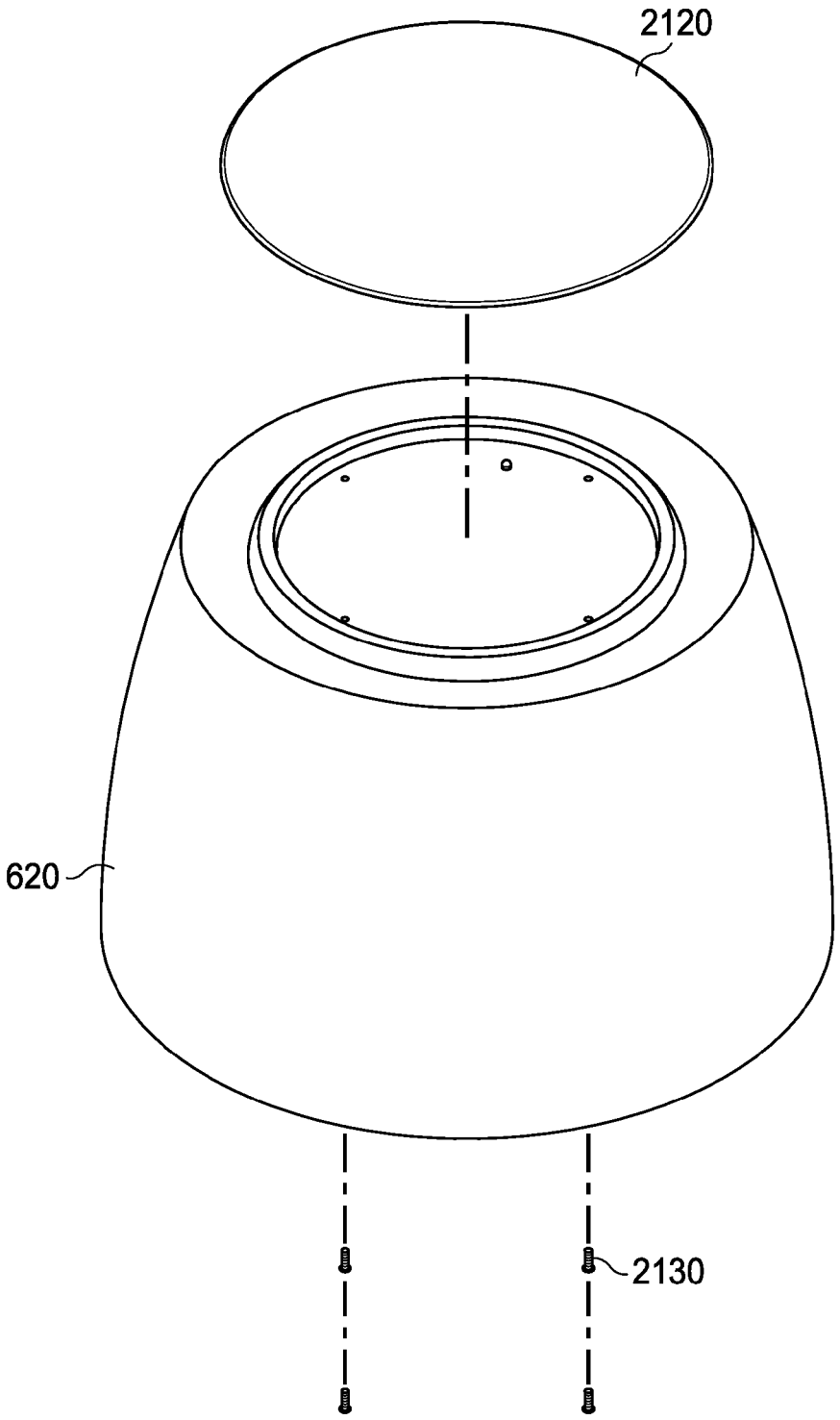
FIG. 21 is an isometric view of further components of the cover assembly of FIG. 6.
Figure 22:
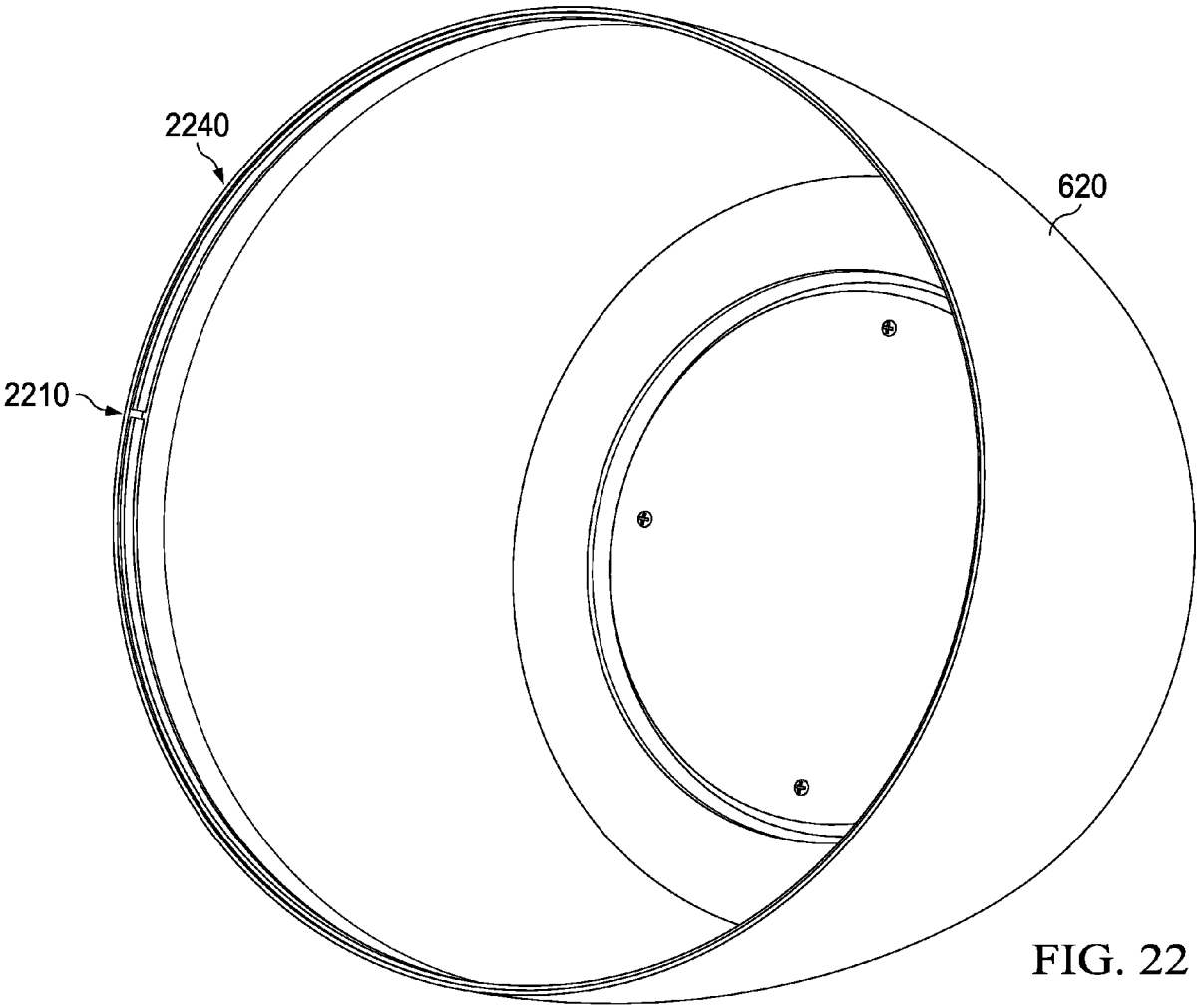
FIG. 22 is an isometric view of further components of the cover assembly of FIG. 6.
Figure 23:
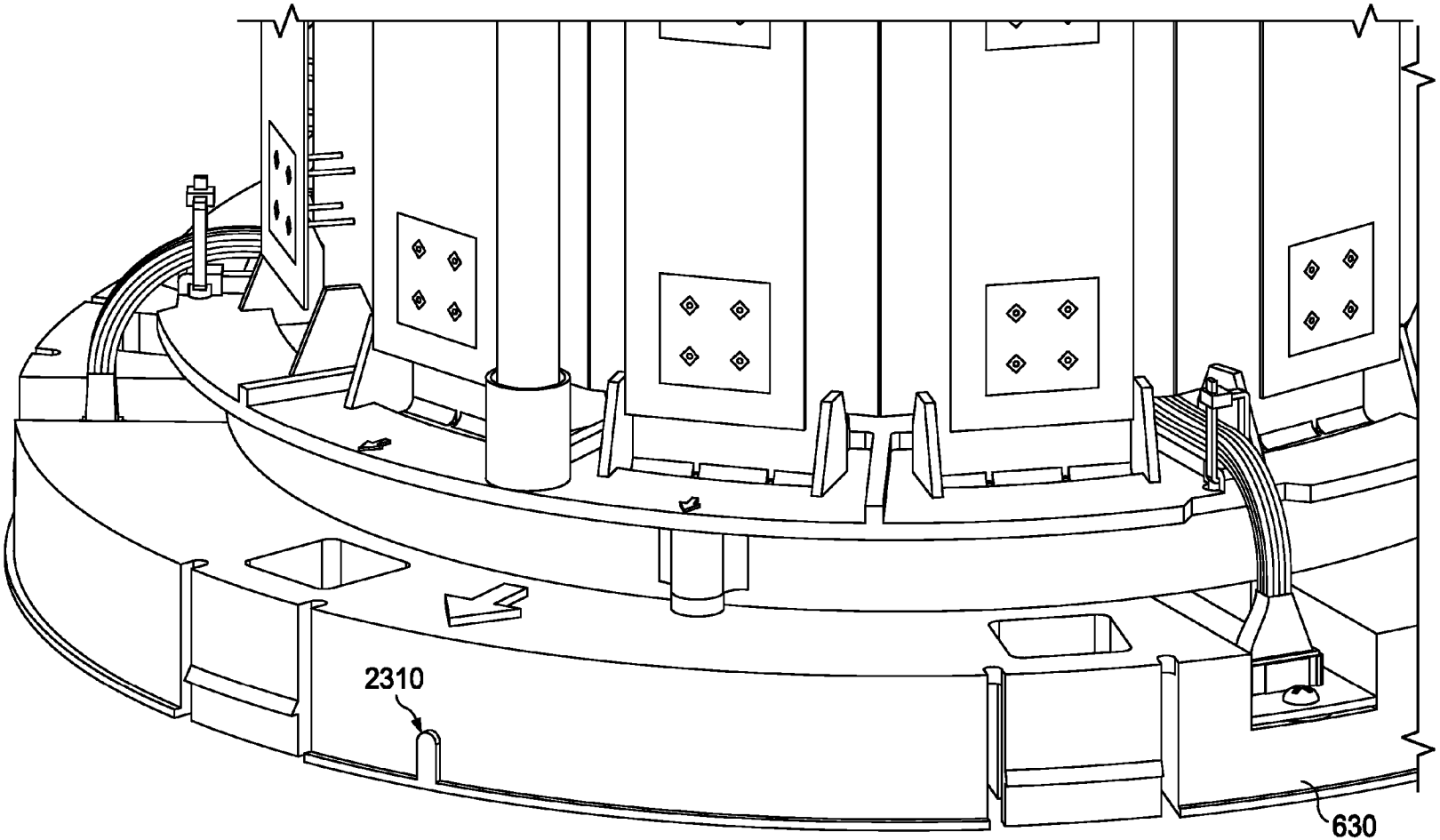
FIG. 23 is an isometric view of further components of the antenna assembly of FIG. 6.
Figure 24:
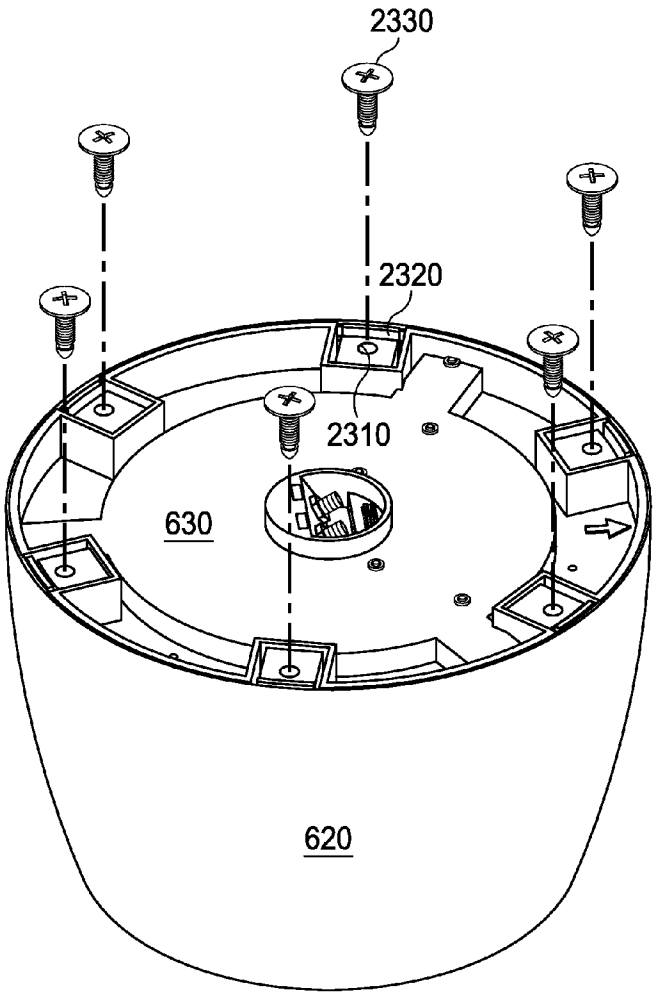
FIG. 24 is an isometric view of further components of the antenna assembly of FIG. 6.

FIG. 21 shows the assembly of the cover 620. A top plate 2120 can be affixed to the top of the cover 620 via a plurality of screws 2130. The top plate 2120 can be added to display the manufacturer's name for example. FIG. 22 shows the bottom edge of the cover 2120. The edge includes a radial groove 2240 at the edge circumference of the cover 620, and at least one notch 2210 that serves to properly align the cover 620 on the antenna assembly 600. FIG. 23 shows a rib 2310 at the edge of the base 630 that fits the notch 2210. The cover 620 is properly placed on the antenna assembly 600 by locking the notch 2210 onto the rib 2310. FIG. 24 shows the bottom surface of the base 630 after placing the cover 620. A plurality of fasteners 2330 (e.g., barbed push fastener) are inserted into respective openings 2310 in the bottom surface to lock corresponding snap tabs 2320 into the groove 2240 of the cover 620. The head of a fastener 2320 prevents a corresponding tab 2320 from being able to flex back out of the groove 2240. Thus, the tab 2320 locks the cover 620 to the base 630. Having a groove, for example instead of a screw boss, allows the cover structure to have a uniform thickness in front of the antenna elements. A screw boss created in the cover would cause a local thickness change (despite the relative steep side of the cover 620).

Figure 25:
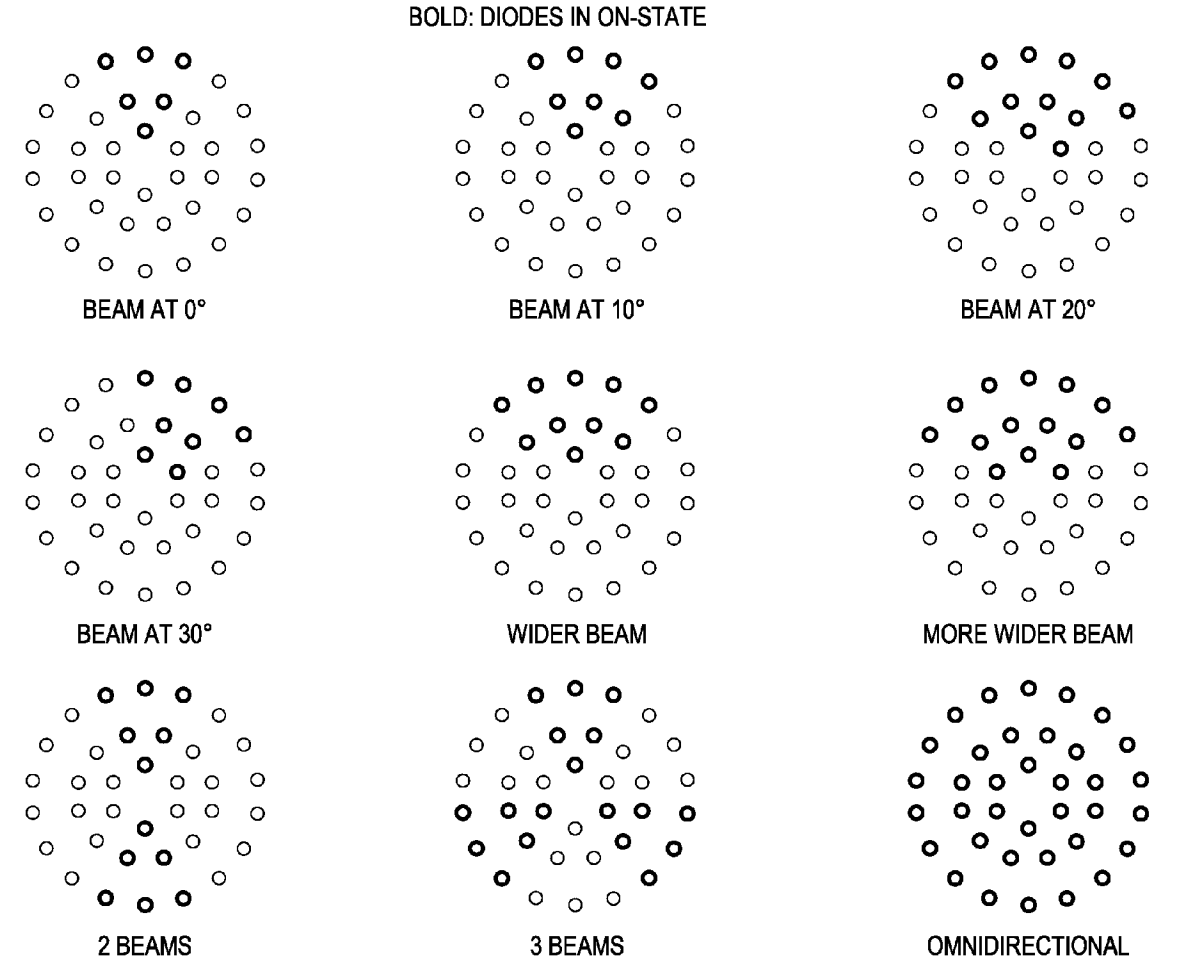
FIG. 25 is an illustration of a plurality of examples for achieving different beam radiation patterns and orientations by controlling a power divider of the antenna.

FIG. 25 illustrates various beam radiation patterns and orientations achievable by controlling a power divider of the antenna, as described above. The patterns include various orientation of the beam (at different angles, e.g., 0, 10°, 20°, 30°), various beam shapes (e.g., wider beam, more wider beam), and various numbers of simulated radiated beams (e.g., in one or more directions). The various beam formations above can be achieved using the same waveguide structures (the same dual port antenna) by tuning ON/OFF different groups of diodes (for different tunable elements).

Figure 26:
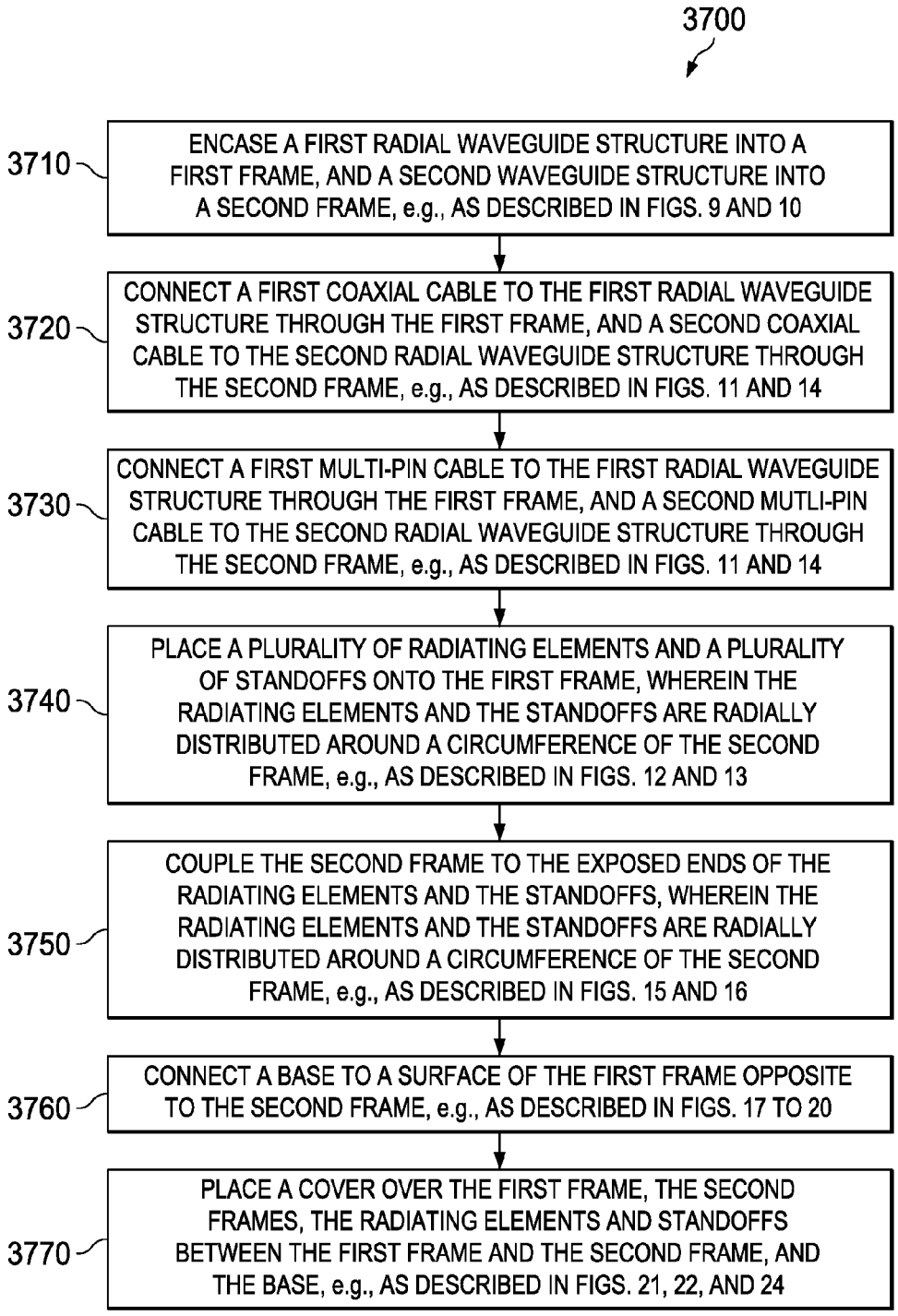
FIG. 26 illustrates a flowchart of an embodiment method for assembling the dual port waveguide antenna.

FIG. 26 shows an embodiment method 3700 for assembling the dual port waveguide antenna described above, e.g., as shown in the antenna assembly 600. At step 3710, a first radial waveguide structure is encased into a first frame, and a second waveguide structure is encased into a second frame, e.g., as described in FIGS. 9 and 10. At step 3720, a first coaxial cable is connected to the first radial waveguide structure through the first frame, and a second coaxial cable is connected to the second radial waveguide structure through the second frame, e.g., as described in FIGS. 11 and 14. At step 3730, a first multi-pin cable is connected to the first radial waveguide structure through the first frame, and a second multi-pin cable is connected to the second radial waveguide structure through the second frame, e.g., as described in FIGS. 11 and 14. At step 3740, a plurality of radiating elements and a plurality of standoffs are placed onto the first frame, wherein the radiating elements and the standoffs are radially distributed around a circumference of the first frame, e.g., as described in FIGS. 12 and 13. At step 3750, the second frame is coupled to the exposed ends of the radiating elements and the standoffs, wherein the radiating elements and the standoffs are radially distributed around a circumference of the second frame, e.g., as described in FIGS. 15 and 16. At step 3760, a base is connected to a surface of the first frame opposite to the second frame, e.g., as described in FIGS. 17 to 20. At step 3770, a cover is placed over the first frame, the second frames, the radiating elements and standoffs between the first frame and the second frame, and the base, e.g., as described in FIGS. 21, 22, and 24. Both the first coaxial cable from the first radial waveguide structure and the second coaxial cable from the second radial waveguide structure are subsequently connected to a radio frequency signal source trough openings in the radiating elements and through corresponding openings in the base. Both the first multi-pin cable from the first radial waveguide structure and the second multi-pin cable from the second radial waveguide structure are connected to a DC switch controller, through second openings in the radiating elements and via a connector board in the base.

Figure 27:
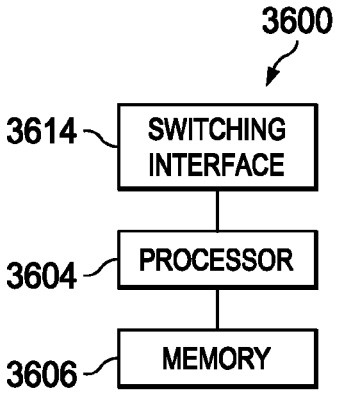
FIG. 27 illustrates a block diagram of an embodiment communications device.

FIG. 27 illustrates a block diagram of an embodiment of a communications device 3800 including a processor 3804, a memory 3806, and a switching interface 3814, which may (or may not) be arranged as shown in FIG. 38. The processor 3804 may be any component capable of performing computations and/or other processing related tasks, and may be equivalent to the microcontroller 250 (discussed above). The memory 3806 may be any component capable of storing programming and/or instructions for the processor 3804. The switching interface 3814 may be any component or collection of components that allows the processor 3804 to manipulate or otherwise control a series of DC switches for the purpose of effectuating beamsteering on an agile antenna.

Figure 28:
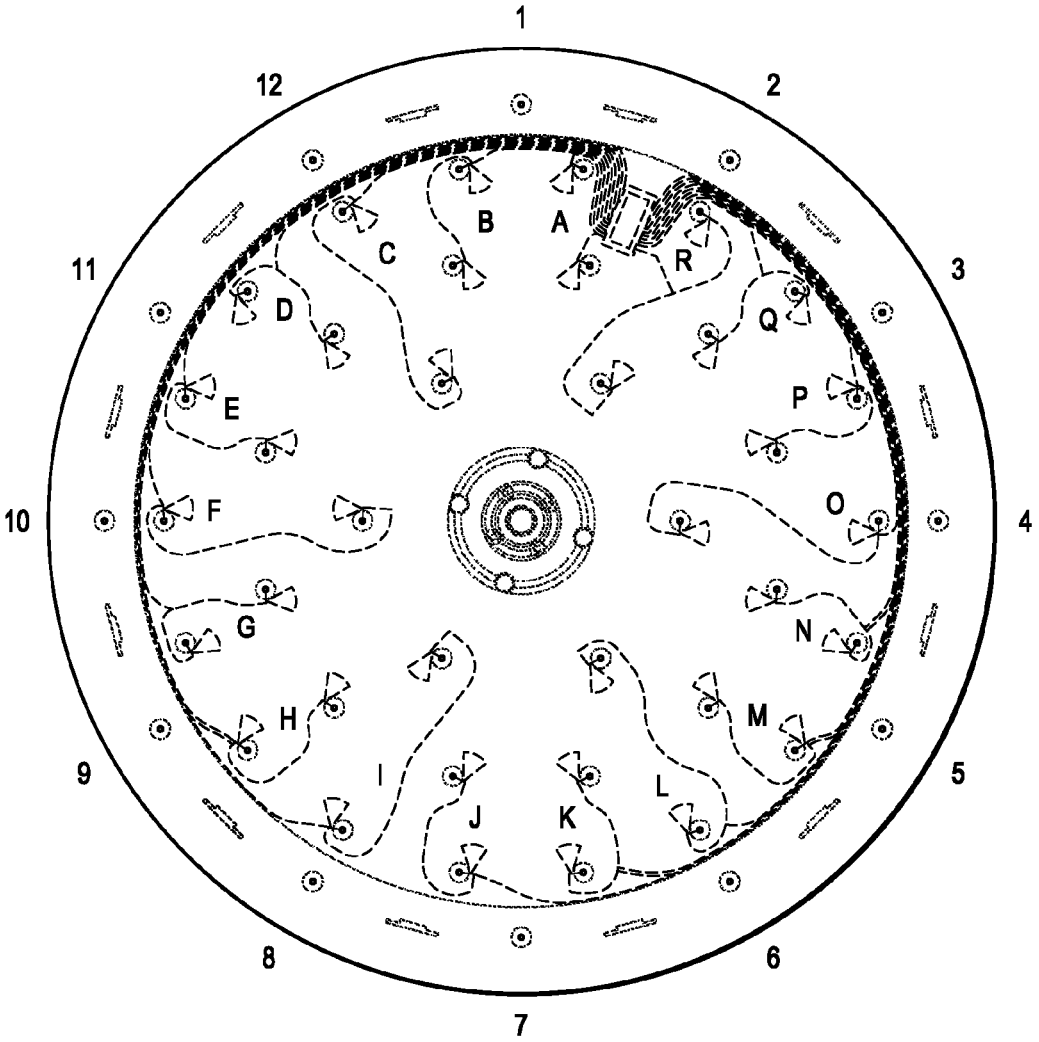
FIG. 28 shows a top view of an embodiment of an upper power divider configuration of the antenna.

FIG. 28 shows a top view of an embodiment of an upper power divider configuration of the antenna. The top view corresponds to the surface of the radial waveguide structure 206 (at the top of the antenna assembly 600). The surface is connected to a line feed 210 and faces a similar surface of the radial waveguide structure 205 (at the bottom of the antenna assembly 600). As described above, different groups of activated tunable elements connected to conductive elements 220 of the radial waveguide structure act as a power divider which steers the RF beam of the antenna in different directions. The different groups of tunable elements are labeled from A to R for the radial waveguide structure 206 in a counter-clockwise direction from the view perspective of FIG. 28. FIG. 28 also shows a plurality of desired beamsteering or emission directions that can be achieved by activating the different groups of tunable elements. The directions are distributed radially with respect to the antenna assembly and are labeled in a clockwise direction from 1 to 12.

Figure 29:
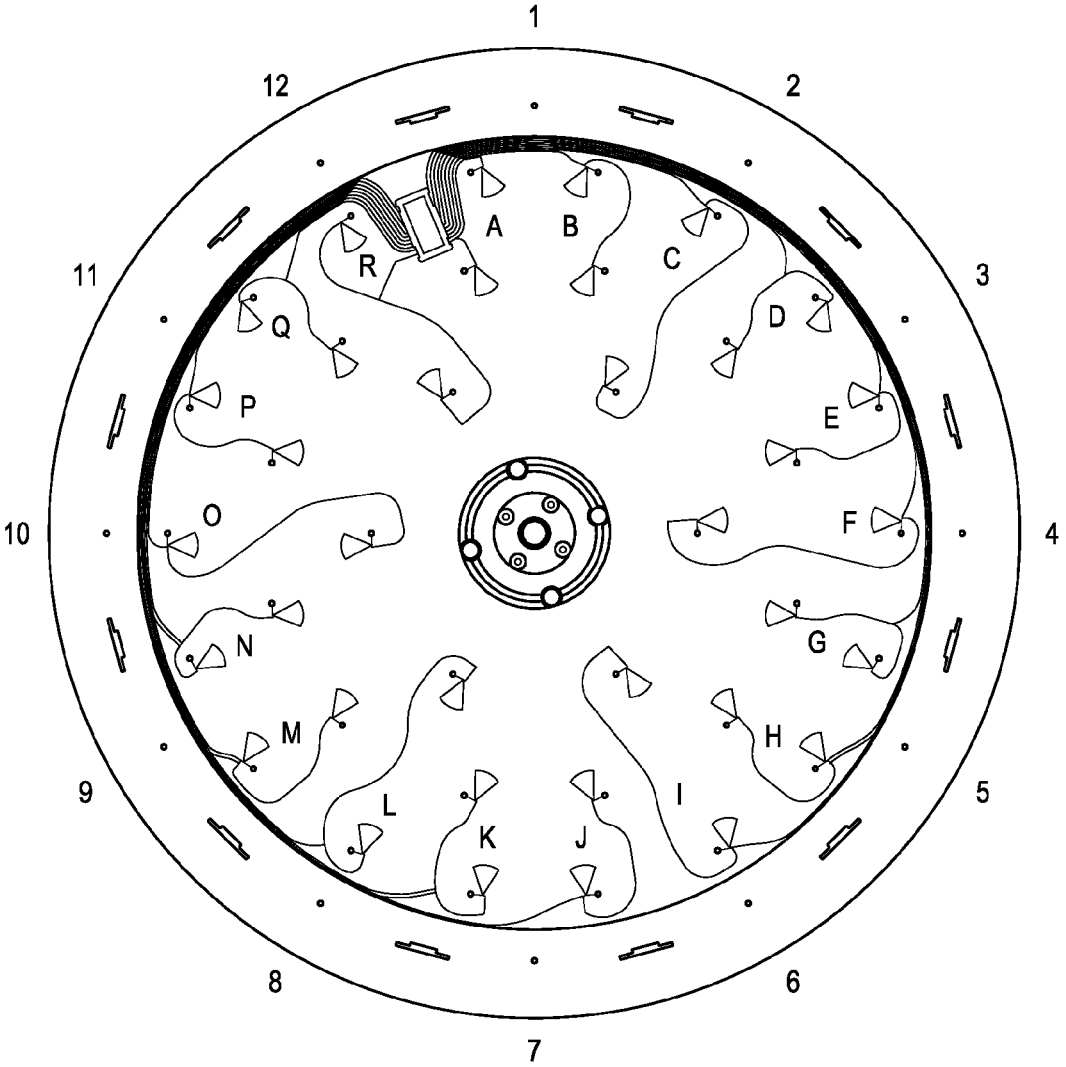
FIG. 29 shows a top view of an embodiment of a lower power divider configuration of the antenna.

FIG. 29 shows a top view of an embodiment of a lower power divider configuration of the antenna. The top view corresponds to the surface of the radial waveguide structure 205. The surface is connected to a line feed 210 and faces the surface of the radial waveguide structure 206 in FIG. 28. The upper and lower power divider configurations of FIGS. 28 and 29 are similar which facilitates the fabrication process. As such, the lower power divider configuration is a mirror reflection of the upper power divider configuration, and the labels for the groups of tunable elements in the lower radial waveguide structure 205 are labeled from A to R in a clock-wise direction from the view perspective of FIG. 29. For this purpose, the same beamsteering directions are shown for both power divider configurations in FIGS. 28 and 29.

FIGS. 30A and 30B show an embodiment of a DC logic PIN-out for a connector with 40 PINs. The shown PIN configuration can be used to control, simultaneously, the upper and lower power dividers described above, and thus control beamsteering, via a DC control system (e.g., the DC control system 400) and the multi-pin cables 1130. The configuration shows the mapping between the directions above (1 to 12) and the pins (labeled 1 to 20). The pins indicated by 1 are switched ON (or OFF) to achieve the corresponding beamsteering direction. In this embodiment, the pins 1 and 2 are grounded and the pins 3 to 20 are used to control the lower power divider, via its corresponding multi-pin cable 1130. The pins 21 and 22 are also grounded and the pins 23 to 40 are used to control the upper power divider, via its corresponding multi-pin cable 1130. The pins for the upper and lower power dividers that correspond to the same direction are switch ON (or OFF) simultaneously. The pins for the same direction are connected to and thus activate (or deactivate) the same groups of tunable elements in the upper and lower power dividers. In other embodiments, other suitable configurations for the upper and lower power dividers and corresponding PIN settings can be used.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. An antenna device comprising:

a first reconfigurable radial waveguide structure;

a first line feed connected at substantially a center of a surface of the first reconfigurable radial waveguide structure;

a second reconfigurable radial waveguide structure coupled to the first reconfigurable radial waveguide structure, wherein the second reconfigurable radial waveguide structure is substantially parallel to and faces the first reconfigurable radial waveguide structure;

a second line feed connected at substantially a center of a surface of the second reconfigurable radial waveguide structure, wherein the first line feed of the first reconfigurable radial waveguide structure faces the second line feed of the second reconfigurable radial waveguide structure;

a plurality of radiating elements positioned between the first reconfigurable radial waveguide structure and the second reconfigurable radial waveguide structure, and distributed radially around a circumference of the first reconfigurable radial waveguide structure and a circumference of the second reconfigurable radial waveguide structure; and a plurality of direct current (DC) switches coupled to the first reconfigurable radial waveguide structure and the second reconfigurable radial waveguide structure, and configured to switch selected tunable elements in a plurality of tunable elements in the first reconfigurable radial waveguide structure and the second reconfigurable radial waveguide structure.

2. The antenna device of claim 1, wherein each one of the first reconfigurable radial waveguide structure and the second reconfigurable radial waveguide structure comprises:

a first radial plate connected to one of the first line feed and the second line feed;

a second radial plate substantially in parallel with the first radial plate on an opposite side from the one of the first line feed and the second line feed; and a plurality of conductive elements connected to the plurality of tunable elements and positioned vertically between the first radial plate and the second radial plate, and interspersed horizontally between the first line feed and the radiating elements.

3. The antenna device of claim 2 further comprising:

a first radial frame enclosing the first reconfigurable radial waveguide structure, the first radial frame comprising a conductive gasket positioned around an inside wall of the first radial frame and in contact with the first radial plate and the second radial plate of the first reconfigurable radial waveguide structure; and a second radial frame enclosing the second reconfigurable radial waveguide structure, the second radial frame comprising a second conductive gasket positioned around an inside wall of the second radial frame and in contact with the first radial plate and the second radial plate of the second reconfigurable radial waveguide structure.

4. The antenna device of claim 2 wherein the plurality of DC switches are configured to activate and deactivate the selected tunable elements in the plurality of tunable elements in the first reconfigurable radial waveguide structure and the second reconfigurable radial waveguide structure simultaneously, wherein activation or deactivation of the DC switches directs propagation and beamsteering of a radio frequency (RF) signal.

5. The antenna device of claim 4, wherein each one of the DC switches is connected to a corresponding grouping of the tunable elements.

6. The antenna device of claim 2, wherein the tunable elements include at least one of PIN diodes and microelectromechanical systems (MEMS).

7. The antenna device of claim 1, wherein the first line feed and the second line feed are coupled to a radio frequency (RF) signal source.

8. An antenna device comprising:

a first reconfigurable radial waveguide structure;

a first radial frame enclosing the first reconfigurable radial waveguide structure a second reconfigurable radial waveguide structure substantially parallel to and facing the first reconfigurable radial waveguide structure;

a second radial frame enclosing the second reconfigurable radial waveguide structure, wherein the second radial frame is coupled substantially in parallel to the first radial frame;

a plurality of radiating elements positioned between the first radial frame and the second radial frame, and distributed radially around a circumference of the first radial frame and a circumference of the second radial frame, wherein the radiating elements are connected to the first reconfigurable radial waveguide structure and to the second reconfigurable radial waveguide structure through the second radial frame; and a plurality of direct current (DC) switches coupled to the first reconfigurable radial waveguide structure and the second reconfigurable radial waveguide structure, and configured to switch selected tunable elements in a plurality of tunable elements in the first reconfigurable radial waveguide structure and the second reconfigurable radial waveguide structure.

9. The antenna device of claim 8 further comprising a conductive gasket positioned around an inside inner wall of each one of the first radial frame and the second radial frame.

10. The antenna device of claim 9, wherein each one of the first radial frame and the second radial frame comprises:

a plurality of cylindrical holders distributed radially around a circumference of an outer surface of each one of the first radial frame and the second radial frame;

one or more frame alignment markers on the outer surface;

a plurality of slots distributed radially around the circumference and configured to fit edge probes at endings of the radiating elements; and guide ribs on both sides of each one of the slots, the guide ribs configured to hold the radiating elements vertical to each outer surface.

11. The antenna device of claim 10, wherein each one of the first reconfigurable radial waveguide structure and the second reconfigurable radial waveguide structure comprises:

a first radial plate connected to the radiating elements through one of the first radial frame and the second radial frame;

a second radial plate substantially in parallel with the first radial plate, wherein the first radial plate and the second radial plate are in contact with the conductive gasket; and a plurality of metallic posts connected to the plurality of tunable elements and positioned vertically between the first radial plate and the second radial plate, and interspersed horizontally between substantially a center of the second radial plate and the radiating elements.

12. The antenna device of claim 8 further comprising:

a first line feed connected at substantially a center of a surface of the first reconfigurable radial waveguide structure through the first radial frame;

a first coaxial cable connected to the first line feed and connected to a radio frequency (RF) signal source through an opening between the radiating elements;

a second line feed connected at substantially a center of a surface of the second reconfigurable radial waveguide structure through the first radial frame; and a second coaxial cable connected to the second line feed and connected to the RF signal source through the opening between the radiating elements.

13. The antenna device of claim 12 further comprising:

a first multi-pin cable connected, via a connector, to the surface of the first reconfigurable radial waveguide structure through the first radial frame, and connected, through an opening between the radiating elements, to the plurality of DC switches and a controller; and a second multi-pin cable connected, via a second connector, to the surface of the second reconfigurable radial waveguide structure through the second radial frame, and connected, through a second opening between the radiating elements, to the DC switches and the controller.

14. The antenna device of claim 13 further comprising:

a first fastening loop that loosely fastens the first coaxial cable to an edge of the first radial frame; and a second fastening loop that loosely fastens the first multi-pin cable to a second edge of the first radial frame.

15. The antenna device of claim 13 further comprising:

a plurality of standoffs positioned between the first radial frame and the second radial frame, and distributed radially around the circumference of the first radial frame and the circumference of the second radial frame;

a radial base coupled to a surface the first radial frame opposite to the second radial frame; and a cover enclosing the first radial frame, the second radial frame, the radiating elements and standoffs between the first radial frame and the second radial frame, and the radial base.

16. The antenna device of claim 15 further comprising a connector board coupled to the surface of the first radial frame and positioned between the radial base and the first radial frame, wherein the connector board connects the first multi-pin cable and the second multi-pin cable to the DC switches and the controller.

17. The antenna device of claim 15, wherein the radial base comprises:

one or more base alignment markers on a surface of the radial base;

an opening for each one of the first coaxial cable and the second coaxial cable;

a corresponding cable label on each opening;

a cover locking rib at an edge of the radial base; and a plurality of cover snap tabs around a bottom circumference of the radial base.

18. The antenna device of claim 17, wherein the cover comprises:

a top plate connected to a surface of the cover; and a base locking notch at an edge of the cover, the base locking notch fits the cover locking rib of the radial base; and a radial groove around a circumference at the edge of the radial base, wherein the radial groove provides a fastening mechanism with the cover snap tabs and allows a uniform thickness shape of the cover.

19. The antenna device of claim 8, wherein each one of the radiating elements comprises:

conductive feed paths on a surface of each one of the radiating elements;

a patch connected to each surface; and edge probes on both ends of each one of the radiating elements, the edge probes having trapezoid cut ends.

20. The antenna device of claim 8, wherein each one of the radiating elements has a shape with step wise edges and cut off corners on both sides at both ends, and wherein the step wise edges provides a self-aligning mechanism with corresponding guide ribs on a surface of each one of the first radial frame and the second radial frame.

21. A method for assembling a dual port waveguide antenna, the method comprising:

encasing a first radial waveguide structure into a first frame;

encasing a second radial waveguide structure into a second frame;

connecting a first radio frequency (RF) source coaxial cable to the first radial waveguide structure through the first frame, and a second RF source coaxial cable to the second radial waveguide structure through the second frame;

connecting a first direct current (DC) switch multi-pin cable to the first radial waveguide structure through the first frame, and a second DC switch multi-pin cable to the second radial waveguide structure through the second frame;

placing a plurality of radiating elements and a plurality of standoffs between the first frame and the second frame, wherein the radiating elements and the standoffs are radially distributed around a circumference of each one of the first frame and the second frame;

connecting a base at a surface of one of the first frame opposite to the second frame; and placing a cover over the first frame, the second frames, the radiating elements and the standoffs between the first frame and the second frame.

22. The method of claim 21 further comprising:

connecting both the first RF source coaxial cable from the first radial waveguide structure and the second RF source coaxial cable from the second radial waveguide structure to a radio frequency signal source trough openings in the radiating elements; and connecting both the first DC switch multi-pin cable from the first radial waveguide structure and the second DC switch multi-pin cable from the second radial waveguide structure to a DC switch controller, through second openings in the radiating elements.

23. The method of claim 22, wherein the first RF source coaxial cable from the first radial waveguide structure and the second RF source coaxial cable from the second radial waveguide structure are connected to a radio frequency signal source through corresponding openings in the base, and wherein the first DC switch multi-pin cable from the first radial waveguide structure and the second DC switch multi-pin cable from the second radial waveguide structure are connected to the DC switch controller via a connector board in the base.

* * * * *